US010800054B2

(12) United States Patent
Stapelbroek et al.

(10) Patent No.: US 10,800,054 B2
(45) Date of Patent: Oct. 13, 2020

(54) BLADE SET AND HAIR CUTTING APPLIANCE

(71) Applicant: KONINKLIJKE PHILIPS N.V., Eindhoven (NL)

(72) Inventors: Martinus Bernardus Stapelbroek, Eindhoven (NL); Jan Van Dalen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 151 days.

(21) Appl. No.: 15/026,278

(22) PCT Filed: Sep. 24, 2014

(86) PCT No.: PCT/EP2014/070341
§ 371 (c)(1),
(2) Date: Mar. 31, 2016

(87) PCT Pub. No.: WO2015/049137
PCT Pub. Date: Apr. 9, 2015

(65) Prior Publication Data

US 2016/0236363 A1 Aug. 18, 2016

(30) Foreign Application Priority Data

Oct. 1, 2013 (EP) ..... 13186851

(51) Int. Cl.
*B26B 19/38* (2006.01)
*B26B 19/06* (2006.01)

(52) U.S. Cl.
CPC ..... *B26B 19/3846* (2013.01); *B26B 19/06* (2013.01)

(58) Field of Classification Search
CPC ..... B26B 19/06; B26B 19/063; B26B 19/066; B26B 19/384; B26B 19/3846;
(Continued)

(56) References Cited

U.S. PATENT DOCUMENTS 2,025,972 A 12/1935 Caster
2,151,965 A 3/1939 Hanley
(Continued)

FOREIGN PATENT DOCUMENTS

AT 157081 B 9/1939
CH 496523 A 9/1970
(Continued)

*Primary Examiner* — Evan H MacFarlane

(57) ABSTRACT

A hair cutting appliance includes a blade set including a first wall portion and a second wall portion, each wall portion defining a first surface, a second surface, and at least one toothed leading edge including a plurality of mutually spaced apart projections provided with respective tips, wherein the first surfaces of the first wall portion and the second wall portion face each other, at least at their leading edges, wherein facing projections along the leading edges of the first and second wall portions are mutually connected at their tips to define a plurality of teeth, wherein the first surfaces of the first wall portion and the second wall portion define therebetween a guide slot for a movable blade and wherein the second surface of the first wall portion at, includes a smoothed transitional region, at least at the forwardly extending projections.

11 Claims, 14 Drawing Sheets

(58) Field of Classification Search
CPC ..... B26B 19/02; B26B 19/04; B26B 19/044; B26B 19/046; B26B 19/12; B26B 19/24
USPC ... 30/43.91, 43.92, 208, 223, 225, 195, 196, 30/209, 210, DIG. 2, 43, 43.1, 43.2, 44, 30/45, 43.8, 43.9
See application file for complete search history.

(56) References Cited

U.S. PATENT DOCUMENTS

| | | | | |
|---|---|---|---|---|
| 2,222,106 | A | 11/1940 | Raymond | |
| 2,251,577 | A * | 8/1941 | Rand, Jr. ..... | B26B 19/042 30/34.1 |
| 2,426,412 | A | 8/1947 | Pinkas | |
| 2,948,063 | A | 8/1960 | Ivar | |
| 3,201,178 | A | 8/1965 | Okubo | |
| 8,065,801 | B2 | 11/2011 | Royle | |
| 8,479,400 | B2 | 7/2013 | Fukutani | |
| 2001/0009068 | A1 * | 7/2001 | Morisugi ..... | B26B 19/06 30/216 |
| 2016/0236363 | A1 | 8/2016 | Stapelbroek | |

FOREIGN PATENT DOCUMENTS

| | | | |
|---|---|---|---|
| DE | 2455574 | A1 | 7/1975 |
| DE | 202005015883 | U1 | 12/2005 |
| EP | 0282117 | A1 | 9/1988 |
| GB | 526172 | A | 9/1940 |
| GB | 1279327 | A | 6/1972 |
| WO | 2005053916 | A1 | 6/2005 |

* cited by examiner

BLADE SET AND HAIR CUTTING APPLIANCE

This application is the U.S. National Phase application under 35 U.S.C. § 371 of International Application No. PCT/EP2014/070341, filed on Sep. 24, 2014, which claims the benefit of International Application No. 13186851.5 filed on Oct. 1, 2013. These applications are hereby incorporated by reference herein.

FIELD OF THE INVENTION

The present disclosure relates to a hair cutting appliance, particularly to an electrically operated hair cutting appliance, and more particularly to a stationary blade of blade set for such an appliance. The blade set may be arranged to be moved through hair in a moving direction to cut hair. The stationary blade may be composed of a first wall portion and a second wall portion that define therebetween a guide slot, where a movable blade may be at least partially encompassed and guided.

BACKGROUND OF THE INVENTION

DE 2 026 509 A discloses a cutting head for a hair and/or beard cutting appliance, the cutting head comprising a stationary comb shaped as a basically tubular laterally extending body, the tubular body comprising two laterally extending bent protruding sections facing away from each other, wherein each bent section comprises a first wall portion and a second wall portion that extend into a common tip portion, the first wall portion and the second wall portion surrounding a guide area for a movable blade, wherein the bent sections comprises a plurality of slots in which to-be-cut hairs can be trapped and guided towards the movable blade during a cutting operation. The movable blade comprises a basically U-shaped profile that cooperates with the first and the second bent section, wherein each leg of the U-shaped profile comprises an outwardly bent edge portion extending into the guide area defined by the respective first and second wall portion, the edge portion further comprising a toothed cutting edge for cutting trapped hair in a relative motion between the toothed cutting edge of the movable blade and a toothed edge of the stationary comb defined by the plurality of slots in the first and the second bent section.

EP 0 282 117 A1 discloses a cutting unit for cutting hair, as used in a shaver, the cutting unit comprising a first and a second cutting member each of which comprising teeth, wherein the second cutting member can be driven so as to perform a reciprocating movement with respect to the first cutting member, wherein the second cutting member is arranged between the first cutting member and a locking member, and wherein the first cutting member and the locking member are connected by means of spacers.

WO 2005/053916 A1 discloses a cutting head for a hair cutting device, the cutting head comprising a lower blade and an upper blade, wherein the lower blade and the upper blade are fixedly connected to each other, wherein a slot is provided between the lower blade and the upper blade, and wherein a movable cutter blade made from sheet metal material and comprising a toothing is arranged in the slot.

U.S. Pat. No. 2,025,972 A discloses a hair cutter comprising a comb having a longitudinally extending slot in its rear edge extending into bases of teeth of the comb, the hair cutter further comprising a toothed cutter bar slidably arranged in the slot and comprising a notch in its rear edge, wherein further a power unit is provided to which the comb is operably connected for movement about a longitudinal axis, and wherein a driving member is provided, the driving member comprising a rounded head engaging the notch and applied to the toothed cutter bar.

For the purpose of cutting body hair, there exist basically two customarily distinguished types of electrically powered appliances: the razor, and the hair trimmer or clipper. Generally, the razor is used for shaving, i.e. slicing body hairs at the level of the skin so as to obtain a smooth skin without stubbles. The hair trimmer is typically used to sever the hairs at a chosen distance from the skin, i.e. for cutting the hairs to a desired length. The difference in application is reflected in the different structure and architectures of the cutting blade arrangement implemented on either appliance.

An electric razor typically includes a foil, i.e. an ultra thin perforated screen, and a cutter blade that is movable along the inside of and with respect to the foil. During use, the outside of the foil is placed and pushed against the skin, such that any hairs that penetrate the foil are cut off by the cutter blade that moves with respect to the inside thereof, and fall into hollow hair collection portions inside the razor.

An electric hair trimmer, on the other hand, typically includes generally two cutter blades having a toothed edge, one placed on top of the other such that the respective toothed edges overlap. In operation, the cutter blades reciprocate relative to each other, cutting off any hairs that are trapped between their teeth in a scissor action. The precise level above the skin at which the hairs are cut off is normally determined by means of an additional attachable part, called a (spacer) guard or comb.

Furthermore, combined devices are known that are basically adapted to both, shaving and trimming purposes. However, these devices merely include two separate and distinct cutting sections, namely a shaving section comprising a setup that matches the concept of powered razors as set out above, and a trimming section comprising a setup that, on the other hand, matches the concept of hair trimmers.

SUMMARY OF THE INVENTION

Unfortunately, common electric razors are not particularly suited for cutting hair to a desired variable length above the skin, i.e., for precise trimming operations. This can be explained, at least in part, by the fact that they do not include mechanisms for spacing the foil and, consequently, the cutter blade from the skin. But even if they did, e.g. by adding attachment spacer parts, such as spacing combs, the configuration of the foil, which typically involves a large number of small circular perforations, would diminish the efficient capture of all but the shortest and stiffest of hairs.

Similarly, common hair trimmers are not particularly suited for shaving, primarily because the separate cutter blades require a certain rigidity, and therefore thickness, to perform the scissor action without deforming. It is the minimum required blade thickness of a skin-facing blade thereof that often prevents hair from being cut off close to the skin. Consequently, a user desiring to both shave and trim his body hair may need to purchase and apply two separate appliances.

Furthermore, combined shaving and trimming devices show several drawbacks since they basically require two cutting blade sets and respective drive mechanisms. Consequently, these devices are heavier and more susceptible to wear than standard type single-purpose hair cutting appliances, and also require costly manufacturing and assembling processes. Similarly, operating these combined devices is often experienced to be rather uncomfortable and complex.

Even in case a conventional combined shaving and trimming device comprising two separate cutting sections is utilized, handling the device and switching between different operation modes may be considered as being time-consuming and not very user-friendly. Since the cutting sections are typically provided at different locations of the device, guidance accuracy (and therefore also cutting accuracy) may be reduced, as the user needs to get used to two distinct dominant holding positions during operation.

It is an object of the present disclosure to provide for an alternative stationary blade, and a corresponding blade set that enables both shaving and trimming. Particularly, a stationary blade and a blade set may be provided that may contribute to a pleasant user experience in both shaving and trimming operations. More preferably, the present disclosure may address at least some drawbacks inherent in known prior art hair cutting blades, as discussed above, for instance. It would be further advantageous to provide for a blade set that may exhibit an improved operating performance while preferably reducing the time required for combined cutting operations.

In a first aspect of the present disclosure, a segmented stationary blade for a blade set for a hair cutting appliance is presented, said blade set being arranged to be moved through hair in a moving direction to cut hair, said blade comprising a first wall portion arranged to serve as a skin facing wall portion during operation, a second wall portion, and an intermediate wall portion, at least the first wall portion and the intermediate wall portion extending in a substantially flat (or: flat) manner, wherein the first wall portion, the second wall portion, and the intermediate wall portion are fixedly interconnected, thereby forming a segmented stack, wherein the intermediate wall portion comprises at least one cut-out portion and is disposed between the first wall portion and the second wall portion, wherein the first wall portion, the second wall portion, and the intermediate wall portion jointly form, at an end of the segmented stack, at least one U-shaped toothed leading edge, wherein the toothed leading edge at least partially extends in a transverse direction Y, t relative to the moving direction assumed during operation, wherein the intermediate wall portion forms, at the at least one toothed leading edge, a filled portion that connects the first wall portion and the second wall portion at the at least one toothed leading edge, wherein the toothed leading edge comprises a plurality of mutually spaced apart projections alternating with respective slots, thereby defining a plurality of teeth and respective tooth spaces, wherein the mutually spaced apart projections at least partially extend forwardly in a longitudinal direction X, r approximately perpendicular (or: perpendicular) to the transverse direction Y, t, wherein the first wall portion, the second wall portion and the at least one cut-out portion in the intermediate wall portion define therebetween a guide slot for an insertable movable blade, and wherein the transversely extending guide slot comprises a vertical clearance height dimension $t_{cl}$ that is larger than an expected vertical thickness dimension $t_m$ of a to-be-mounted movable blade, wherein the vertical clearance height dimension $t_{cl}$ is selected such that a resulting assembly clearance height dimension $t_{rcl}$ provides for a defined clearance fit mating of the to-be-mounted movable blade in the guide slot.

In other words, put more generally, a blade set for a hair cutting appliance is presented, said blade set being arranged to be moved through hair in a moving direction to cut hair, said blade set comprising a movable blade and a stationary blade; wherein the stationary blade is arranged to at least partially enclose the movable blade during operation of the blade set and to guide the movable blade in at least a first direction; wherein the movable blade comprises a main portion and a cutting portion; wherein the stationary blade comprises a first, second and third guard portion; each guard portion having a first and second surface, the first side of the respective guard portion being the skin facing side and the second side being the side facing away from the skin; wherein the first, second and third guard portions at least partially enclose the cutting portion of the movable blade such that when seen in the moving direction of the blade set the third guard portion precedes the cutting portion and the first and second guard portions extend from the third guard portion at a skin facing side of the movable blade and a side facing away from the skin respectively; and wherein the distance between the second side of the first guard portion and the first side of the second guard portion is selected such that a defined clearance fit mating of the movable blade is provided.

The presently disclosed stationary blade may comprise at least one essentially U-shaped leading edge, and may have a first, skin-contacting wall and a second, supporting wall. The walls may extend oppositely and generally parallel to each other, and may be connected to each other along a leading edge under the formation of a series of spaced apart, U-shaped (i.e. double-walled) teeth. The overall U-shape of the stationary blade, and more in particular the U-shape of the teeth, reinforces the structure of the stationary blade. Between the legs of the U-shaped teeth a slot may be provided in which the movable may be accommodated and guided. In other words, the stationary blade may comprise an integrated guard portion comprising a plurality of teeth that may, at the same time, define an integrated protective cage for the teeth of the movable blade. Consequently, the outline of the stationary blade may be shaped such that the teeth of the movable blade cannot protrude outwardly beyond the stationary blade teeth.

Particularly, the structural strength of the blade set may be improved, compared to a conventional single planar cutter blade of a hair trimmer. The second wall portion may serve as a backbone for the blade set. Overall stiffness or strength of the blade set may be enhanced as well, compared to conventional shaving razor appliances. This allows the first, skin-contacting wall of the stationary blade to be made significantly thinner than conventional hair trimmer cutter blades, so thin in fact, that in some embodiments its thickness may approach that of a razor foil, if necessary.

The stationary blade may, at the same time, provide the cutting edge arrangement with sufficient rigidity and stiffness. Consequently, the strengthened toothed cutting edges may extend outwardly, and may comprise tooth spaces between respective teeth that may be, viewed in a top view, U-shaped or V-shaped and therefore may define a comb-like receiving portion which may receive and guide to-be-cut hairs to the cutting edges provided at the movable blade and the stationary blade, basically regardless of an actual length of the to-be-cut hairs. Consequently, the blade set is also adapted to efficiently capture longer hairs, which significantly improves trimming performance. However, also shaving off longer hairs may be facilitated in this way since the to-be-cut hairs may be guided to the cutting edge of the teeth without being excessively bent by the stationary blade, as might be the case with the foils of conventional shaving appliances. The stationary blade thus may provide for both adequate shaving and trimming performance.

This embodiment is based on the insight that, thanks to the segmented structure of the stationary blade, the first wall portion, the second wall portion and the intermediate wall portion may be advantageously shaped and defined so as to provide for further functionality which typically required additional components in conventional hair cutting blade sets. By way of example, conventional hair cutting blade sets typically involve stationary blades and movable blades that are pushed against each other by biasing members. Consequently, manufacturing and assembling the conventional blades requires higher efforts.

The currently presented approach may take advantage of the fact that a higher freedom of design can be achieved thanks to the segmented structure of the stationary blade. Consequently, the intermediate wall portion may be selected and defined to have a height extension (thickness) that is slightly larger than a height extension (thickness) of a to-be-mounted movable blade in the guide slot. Consequently, the movable blade may be form-fitted in the guide slot. Manufacturing efforts can be significantly reduced in this way.

Furthermore, the height extension of the intermediate wall portion and the height extension of the movable blade may be selected such that a resulting clearance is, on the one hand, tight enough that rattling and undesired noise exposures can be avoided during operation, and, on the other hand, loose enough to avoid excessive friction which might increase to the risk of blockages and intense frictional heat generation. It is worth mentioning in this regard that heat generation induced by the cutting motion of the movable blade with respect to the stationary blade is generally regarded as an important factor for the user experience since the blade set often touches the heat sensitive skin, particularly when shaving hairs close to the skin or at the skin level.

The stationary guide in accordance with the principles of the present disclosure may therefore provide for a reduction of wear, for an improved user sensation and for a simplification of required manufacturing and assembling steps. In other words, the stationary blade and the movable blade themselves may perform the form-fitted movable blade assembling.

As used herein, the term transverse direction may also refer to a lateral direction, and to a circumferential (or: tangential) direction. Basically, a linear configuration of the blade set may be envisaged. Furthermore, also a curved or circular configuration of the blade set may be envisaged which may also include shapes that comprise curved or circular segments. Generally, the transverse direction may be regarded as being (substantially) perpendicular to an intended moving direction during operation. The latter definition may apply to both linear and curved embodiments.

The spaced-apart projections forming the teeth of the stationary blade may be arranged as laterally and/or circumferentially spaced apart projections, for instance. The projections may be spaced apart in parallel, particularly in connection with the linear embodiments. In some embodiments, the projections may be circumferentially spaced apart, i.e., aligned or arranged at an angle relative to each other. The guide slot may be arranged as transversally extending guide slot which may include a laterally extending and/or a circumferentially extending guide slot. It may be also envisaged that the guide slot is a substantially tangentially extending guide slot. Generally, a filled region, where the first wall portion and the second wall portion are connected, may be regarded as or formed by a third, intermediate wall portion. In other words, the first wall portion and the second wall portion may be mediately connected via the intermediate wall portion at their leading edges.

Generally, the stationary blade and the movable blade may be configured and arranged such that, upon linear or rotational motion of the movable blade relative to the stationary blade, the toothed leading edge of the movable blade cooperates with the teeth of the stationary blade to enable cutting of hair caught therebetween in a cutting action. Linear motion may particularly refer to reciprocating linear cutting motion.

As used herein, the term vertical shall not be construed in a limiting way, since it is primarily introduced for illustrative purposes. Rather, the term vertical or vertical direction may also be referred to as generally equivalent to a thickness dimension and/or height dimension.

According to preferred embodiment, the first wall portion forms a first layer, wherein the second wall portion form a second layer, wherein the intermediate wall portion forms an intermediate layer, and wherein the first layer, the second layer and the intermediate layer form a layered stack. Particularly when the stationary blade is formed from a plurality of layers, each layer may be well adapted to its actual assigned purpose and function without being confronted with excessive design limits that are inherent in conventional stationary blade designs.

It may further preferred in the regard that the resulting assembly clearance height dimension $t_{rcl}$ is in the range of about 0.003 mm to about 0.050 mm, preferably in the range of about 0.005 mm to about 0.030 mm. This is particularly beneficial since the desired clearance fit mating may be achieved in this way. Excessive rattling and friction due to the cutting motion may be avoided.

It is particularly preferred that the intermediate wall portion comprises a vertical thickness dimension $t_i$ that is equivalent to the vertical clearance height dimension $t_{cl}$ of the guide slot. This may be achieved, for instance, when at least the intermediate wall portion is provided as intermediate segment obtained from a sheet or slice pre-product, particularly from a sheet-metal layer.

According to a preferred embodiment, the first wall portion, the second wall portion, and the intermediate wall portion jointly form, at a first longitudinal end of the segmented stack, a first toothed leading edge, and at a second longitudinal end of the segmented stack, a second toothed leading edge, wherein the first leading edge and the second leading edge are facing away from each other, wherein each of the first leading edge and the second leading edge comprises a teeth portion, and wherein the stationary blade is arranged for housing a movable blade comprising two corresponding toothed leading edges.

In yet another embodiment, the at least one cut-out portion in the intermediate wall portion further defines an inner guide portion of the intermediate wall portion for guiding the movable blade for lateral movement, and particularly for preventing the movable blade from longitudinal movement with respect to the stationary blade. Consequently, the movable blade may be received and guided in both the height dimension and the longitudinal dimension.

This embodiment may be further developed in that the at least one cut-out portion in the intermediate wall portion, viewed in a top view plane perpendicular to the height direction z, is basically U-shaped, having a first leg arranged at a first leading edge, a second leg arranged at a second leading edge, and a transition portion connecting the first leg and the second leg, wherein the first leg and the second leg define therebetween the inner guide portion having a longitudinal extension that is adapted to a longitudinal clearance dimension of the to-be-mounted movable blade for providing clearance fit mating, in the longitudinal direction X, r, of the to-be-mounted movable blade in the guide slot.

Another aspect of the present disclosure is directed to a blade set for a hair cutting appliance, said blade set being arranged to be moved through hair in a moving direction to cut hair, said blade set comprising a stationary blade; and a movable blade with at least one toothed leading edge, said movable blade being movably arranged within the guide slot defined by the stationary blade, such that, upon lateral motion or rotation of the movable blade relative to the stationary blade, the at least one toothed leading edge of the movable blade cooperates with corresponding teeth of the stationary blade to enable cutting of hair caught therebetween in a cutting action. Particularly, the stationary blade and the movable blade of the blade set may be formed in accordance with at least some of the aspects and embodiments discussed herein It may be preferred that the movable blade is, at least in one of the vertical height direction z and the longitudinal direction X, r, unbiasedly mounted in the guide slot. In other words, the movable blade can be mounted without being biased by a biasing member, such as a spring element, etc.

According to preferred embodiment of the blade set, the at least one cut-out portion in the intermediate wall portion further defines a lateral opening at a transverse end of the segmented stack, and wherein the movable blade comprises a longitudinal overall dimension that is smaller than a longitudinal dimension of the at least one cut-out portion at the transverse end. The lateral opening may serve, at least in the course of the manufacturing process, as an insertion opening for the movable blade.

According to yet another embodiment of the blade set, the second wall portion comprises at least one cut-out portion through which a drive engagement member can be guided that engages the movable blade for driving the movable blade with respect to the stationary blade.

According to still another embodiment of the blade set, the inner guide portion of the intermediate wall portion defined by the at least one cut-out portion thereof comprises at least one outwardly facing transversely extending guide surface facing the at least one leading edge where the at least one teeth portion is arranged, wherein the movable blade comprises a contact portion facing the inner guide portion, the contact portion comprising at least one contact element for contacting the inner guide portion, such that the movable blade, when housed in the stationary blade, is guided for lateral (or: transverse) movement and particularly prevented from longitudinal movement with respect to the stationary blade. Consequently, the movable blade may be form-fitted in the stationary blade in both the transverse and the vertical direction.

This embodiment may be further developed in that the at least one cut-out portion in the intermediate wall portion, viewed in a top view plane perpendicular to the height dimension, is basically U-shaped, comprising a first leg arranged at the first leading edge, a second leg arranged at the second leading edge, and a transition portion connecting the first leg and the second leg, wherein the movable blade is basically U-shaped, comprising a first arm, a second arm and a connector portion connecting the first arm and the second arm, wherein the first arm is basically mounted within the first leg of the at least one cut-out portion, wherein the second arm is basically mounted within the second leg of the at least one cut-out portion, wherein the connector portion is basically mounted within the transition portion of the at least one cut-out portion, wherein the first arm comprises a first inwardly facing contact portion facing a first outwardly facing transversely extending guide surface of the inner guide portion, and wherein the second arm comprises a second inwardly facing contact portion facing a second outwardly facing transversely extending guide surface of the inner guide portion.

According to an even further embodiment of the blade set, the first inwardly facing contact portion comprises at least one respective contact element formed as at least one inwardly extending guiding tab, wherein the second inwardly facing contact portion comprises at least one respective contact element formed as at least one inwardly extending guiding tab, and wherein the at least one inwardly extending guiding tab of the first inwardly facing contact portion and the at least one inwardly extending guiding tab of the second inwardly facing contact portion are longitudinally spaced apart by a longitudinal clearance dimension $l_{gt}$ that is adapted to a longitudinal extension $l_{gp}$ of the inner guide portion for providing clearance fit mating, in the longitudinal direction X, r, of the to-be-mounted movable blade in the guide slot.

It might be even further preferred in this context that at least one guiding tab of the movable blade comprises a convexly curved contact surface that is movable along a respective outwardly facing transversely extending guide surface of the inner guide portion.

Yet another aspect of the present disclosure is directed to a hair cutting appliance comprising a housing accommodating a motor, and a blade set, wherein the stationary blade is connectable to the housing, and wherein the movable blade is operably connectable to the motor, such that the motor is capable of linearly driving or rotating the movable blade within in the guide slot of the stationary blade. Particularly, the blade set may be formed in accordance with at least some of the aspects and embodiments discussed herein.

These and other features and advantages of the disclosure will be more fully understood from the following detailed description of certain embodiments of the disclosure, taken together with the accompanying drawings, which are meant to illustrate and not to limit the disclosure.

BRIEF DESCRIPTION OF THE DRAWINGS

Several aspects of the disclosure will be apparent from and elucidated with reference to the embodiments described hereinafter. In the following drawings

FIGS. 16*a*-16*f* illustrate a layered structure of an exemplary blade set in accordance with the principles of the present disclosure, being in production, at several stages of a manufacturing process, wherein FIG. 16*a* shows a schematic perspective top view of several segments or layers being provided in the form of strip material;

FIG. 16*b* illustrates a schematic partial perspective top view of a bonded strip being formed from several segments or layers;

FIG. 16*c* illustrates a schematic perspective top view of a segmented stack obtained FIG. 16*d* illustrates a schematic enlarged partial perspective side view of the layered stack shown in FIG. 16*c*, wherein a leading edge portion of the layered stack has been machined;

FIG. 16*e* illustrates a schematic partial enlarged perspective top view of a leading edge portion of the layered stack shown in FIG. 16*d*, wherein, at the leading edge, a plurality of longitudinal projections has been formed;

FIG. 16*f* illustrates a schematic enlarged perspective top view of the leading edge of the layered stack in accordance with FIG. 16*e*, wherein edges of the longitudinal projections have been processed;

DETAILED DESCRIPTION OF THE INVENTION

Figure 1:
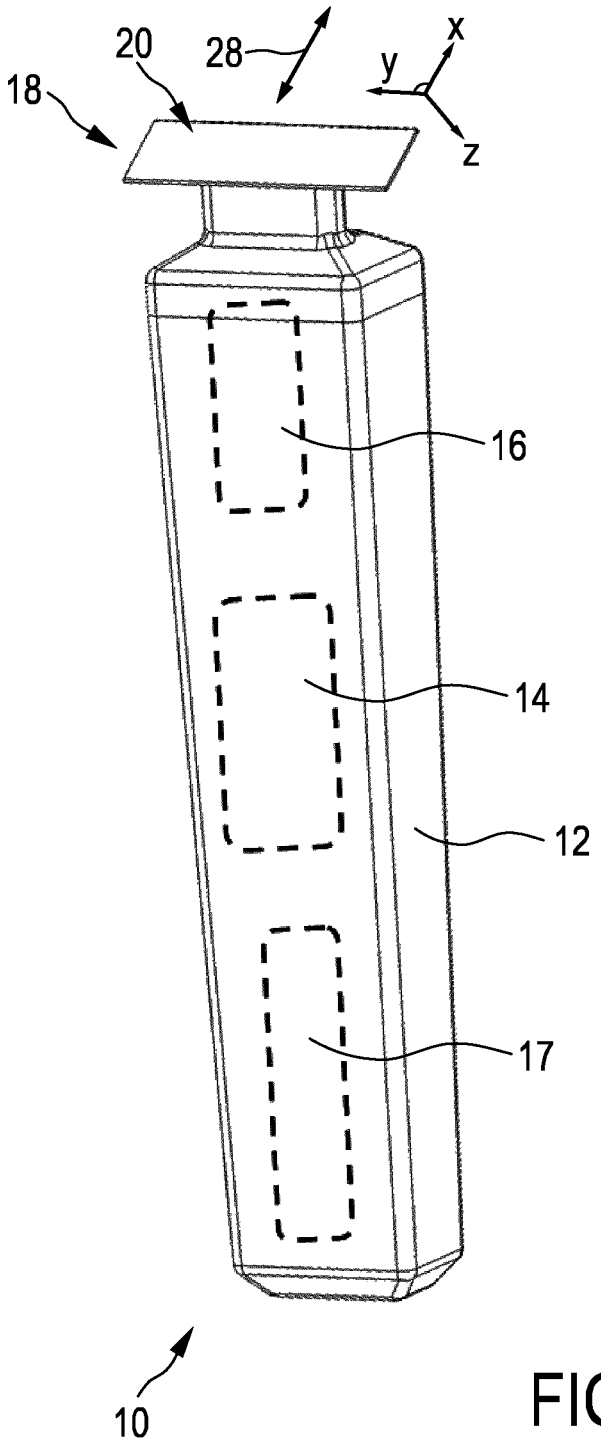
FIG. 1 shows a schematic perspective view of an exemplary electric hair cutting appliance fitted with an exemplary embodiment of a blade set in accordance with the present disclosure.

FIG. 1 schematically illustrates, in a simplified perspective view, an exemplary embodiment of a hair cutting appliance 10, particularly an electric hair cutting appliance 10. The cutting appliance 10 may include a housing 12, a motor indicated by a dashed block 14 in the housing 12, and a drive mechanism indicated by a dashed block 16 in the housing 12. For powering the motor 14, at least in some embodiments of the cutting appliance 10, an electrical battery, indicated by a dashed block 17 in the housing 12, may be provided, such as, for instance, a rechargeable battery, a replaceable battery, etc. However, in some embodiments, the cutting appliance 10 may be further provided with a power cable for connecting a power supply. A power supply connector may be provided in addition or in the alternative to the (internal) electric battery 12.

The cutting appliance 10 may further comprise a cutting head 18. At the cutting head 18, a blade set 20 may be attached to the hair cutting appliance 10. The blade set 20 may be driven by the motor 14 via the drive mechanism 16 to enable a cutting motion.

The cutting motion may generally regarded as relative motion between a stationary blade 22 and a movable blade 24 which are shown and illustrated in more detail in FIGS. 2-18, and will be described and discussed hereinafter. Generally, a user may grab and guide the cutting appliance 10 through hair in a moving direction 28 to cut hair. In some applications, the cutting appliance 10, or, more specifically, the cutting head 18 including the blade set 20, can be passed along skin to cut hair growing at the skin. When cutting hair closely to the skin, basically a shaving operation can be performed aiming at cutting (or: chopping) at the level of the skin. However, also clipping (or: trimming) operations may be envisaged, wherein the cutting head 18 comprising the blade set 20 is passed along a path at a desired distance relative to the skin. Prior art blade sets are generally not capable of providing both smooth shaving close to the skin and cutting (or: trimming) at a distance from the skin.

When being guided or led through hair, the cutting appliance 10 including the blade set 20 is typically moved along a common moving direction which is indicated by the reference numeral 28 in FIG. 1. It is worth mentioning in this connection that, given that the hair cutting appliance 10 is typically manually guided and moved, the moving direction 28 thus not necessarily has to be construed as a precise geometric reference entity having a fixed definition and relation with respect to the orientation of the cutting appliance 10 and its cutting head 18 fitted with the blade set 20. That is, an overall orientation of the hair cutting appliance 10 with respect to the to-be-cut hair at the skin may be construed as somewhat unsteady. However, for illustrative purposes, it can be fairly assumed that the (imaginary) moving direction is parallel (or: generally parallel) to a main axis of a coordinate system which may serve in the following as a means for describing structural features of the blade set 20.

For ease of reference, coordinate systems are indicated in several of FIGS. 1-18. By way of example, a Cartesian coordinate system X-Y-Z is indicated in several of the FIGS. 1-13. An X axis of the respective coordinate system extends in a longitudinal direction generally associated with length, for the purpose of this disclosure. A Y axis of the coordinate system extends in a lateral (or: transverse) direction generally associated with width, for the purpose of this disclosure. A Z direction of the coordinate system extends in a height or thickness direction which also may be referred to for illustrative purposes, at least in some embodiments, as a generally vertical direction. It goes without saying that an association of the coordinate system to characteristic features and/or extension of the stationary blade is primarily provided for illustrative purposes and shall not be construed in a limiting way. It should be understood that those skilled in the art may readily convert and/or transfer the coordinate system provided herein when being confronted with alternative embodiments, respective figures and illustrations including different orientations. It is worth noting in this connection that the (linear) embodiment of the blade set 20 illustrated in FIGS. 2-13 may generally involve a single-sided layout comprising a single toothed cutting edge at only one longitudinal end, or a double-sided layout comprising two generally opposing toothed cutting edges mutually defined by respective toothed leading edges of the stationary blade 22 and the movable blade 24.

Figure 14:
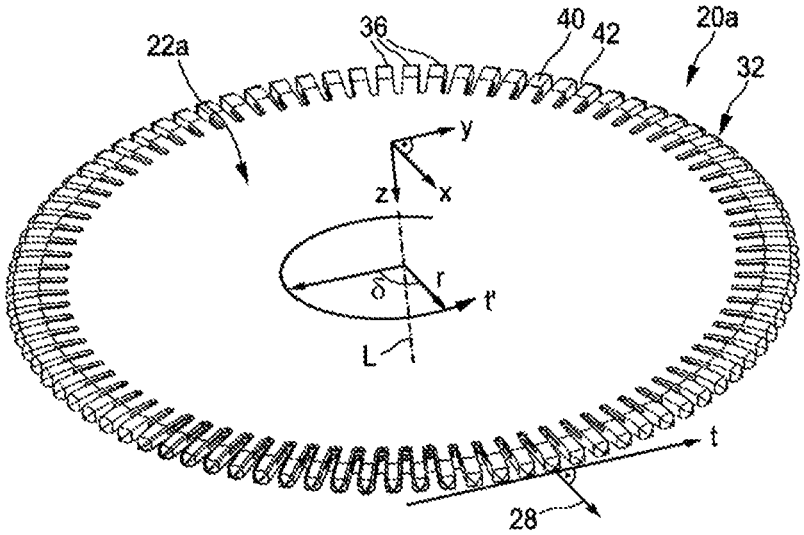
FIG. 14 is a perspective top view of an alternative embodiment of a blade set in accordance with the principles of the present disclosure.
Figure 15A:
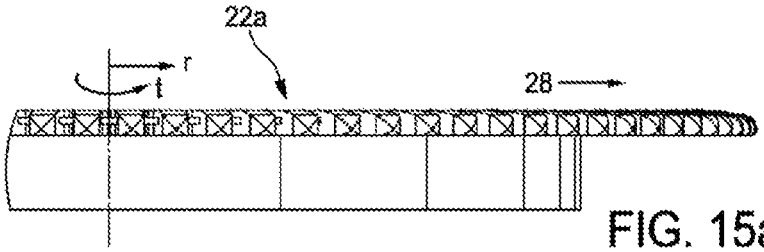
FIG. 15*a* shows an enlarged partial side view of the stationary blade of the blade set shown in FIG. 14.
Figure 15B:
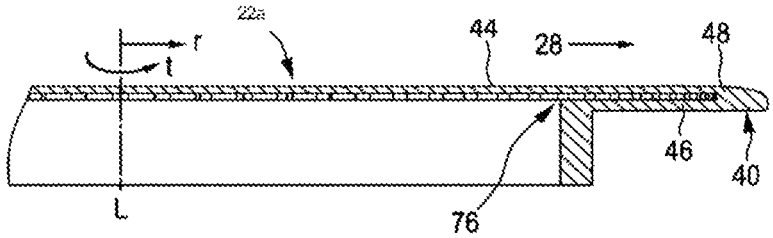
FIG. 15*b* shows an enlarged partial cross-sectional view of the stationary blade shown in FIG. 15*a;*

In connection with the alternative embodiment of the blade set 20*a* shown in FIGS. 14, 15*a* and 15*b*, an alternative coordinate system is presented mainly for illustrative purposes. As can be seen in FIG. 14, a polar coordinate system is provided having a central axis L which may basically correspond to the height- (or: thickness-) indicating axis Z of the Cartesian coordinate system. The central axis L may also be regarded as central axis of rotation. Furthermore, a radial direction or distance r originating from the central axis L is indicated in FIGS. 14, 15*a* and 15*b*. Furthermore, a coordinate δ (delta) indicating an angular position may be provided depicting an angle between a reference radial direction and a present radial direction. Additionally, a curved arrow t', particularly a circumferential arrow t' is illustrated in FIGS. 14, 15*a* and 15*b*. The curved arrow t' indicates a circumferential and/or tangential direction, also indicated by the straight tangential arrow t shown in FIG. 14. It will be readily understood by those skilled in the art that several aspects of the present disclosure described in connection with one embodiment are not limited to the particular disclosed embodiment and, therefore, can be readily transferred and applied to other embodiments, regardless of whether they are introduced and presented in connection with a Cartesian coordinate system or a cylindrical coordinate system.

Figure 3:
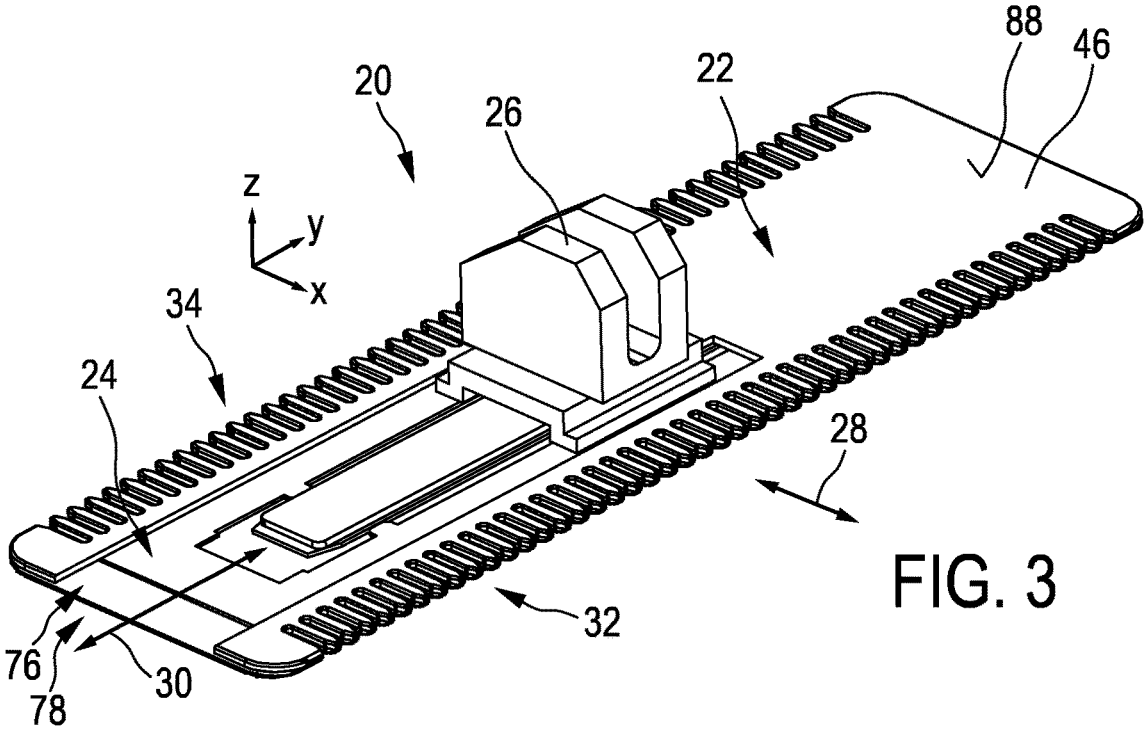
FIG. 3 is a schematic perspective top view of the blade set shown in FIG. 2.

The cutting motion between the movable blade 24 and the stationary blade 22 may basically involve a linear relative motion, particularly a reciprocating linear motion, refer to FIG. 3 (reference number 30), for instance. However, particularly in connection with the embodiment shown in FIGS. 14, 15*a*, 15*b*, it will be understood that the relative cutting motion between the stationary blade 22 and the movable blade 24 may also involve a (relative) rotation. The cutting rotational motion may involve a uni-directional rotation. Furthermore, in the alternative, cutting motion may also involve a bi-directional rotation, particularly an oscillation. Several arrangements of the drive mechanism 16 for the cutting appliance 10 are known in the art that enable linear and/or rotational cutting motions. In particular with reference to an oscillating cutting motion it is further noted that a curved or circular blade set 20*a* does not necessarily have to be shaped in a full circular manner. By contrast, the curved or circular blade set 20*a* may also be shaped as a mere circular segment or a curved segment. It is further worth mentioning in this connection that those skilled in the art understood that particularly a circular blade set 20*a* arranged for rotational cutting motion having a considerably large radius may be construed, for the sake of understanding, as an approximate linearly shaped blade set, particular when only a portion or circular segment of a respective leading edge is considered. Consequently, also the Cartesian coordinate system for defining and explain the linear embodiment may be transferred to and is illustrated in FIG. 14.

Figure 2:
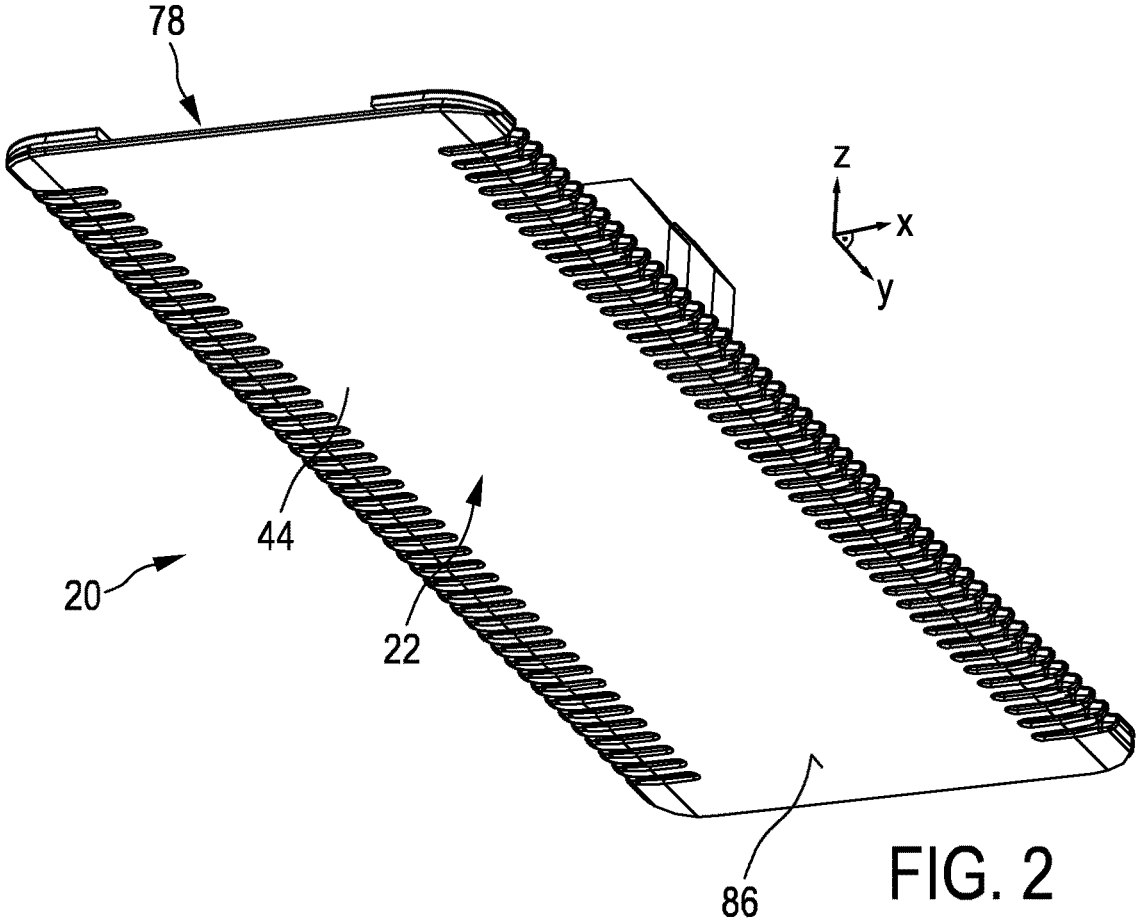
FIG. 2 shows a schematic perspective bottom view of a blade set comprising a stationary blade and a movable blade in accordance with the present disclosure that is attachable to the hair cutting appliance shown in FIG. 1 for hair cutting operations.

FIGS. 2-13 illustrate embodiments and aspects of linearly shaped blade sets 20 introduced in FIG. 1. As can be seen in FIGS. 2 and 3, the blade set 20 comprises a stationary blade 22 (i.e., the blade of the blade set 20 that is typically not directly driven by the motor 14 of the cutting appliance 10). Furthermore, the blade set 20 comprises a movable blade 24 (i.e., the blade of the blade set 20 that, when attached to the cutting appliance 10, may be driven by the motor 14 for generating a cutting motion with respect to the stationary blade 22). A linear (reciprocating) cutting motion is illustrated in FIG. 3 by a double arrow indicated by reference numeral 30. In other words, the movable blade 24 may be moved with respect to the stationary blade 22 along the transverse (or: lateral) direction, refer to the Y axis in FIG. 3. Generally, the linear cutting motion may involve relatively small bi-directional strokes, and may therefore be construed as reciprocating linear motion. Furthermore, the (assumed) moving direction 28 is illustrated in FIG. 3. Theoretically, when cutting hair, the cutting appliance 10 and, consequently, the blade set 20 shall be moved along a direction 28 that may be perpendicular to the lateral or transverse direction Y. Further referring in this connection to the alternative embodiment of the circular or curved blade set 20*a* shown in FIGS. 14, 15*a* and 15*b*, it becomes clear that for this shape the (imaginary) ideal moving direction 28 may be perpendicular to the tangential or circumferential direction t at a forward leading point of the blade set 20*a* during the guided feed motion through the to-be-cut hair. In other words, the ideal moving direction 28 for the curved or circular embodiment of the blade set 20*a* may be generally coincident with the actual radial direction r extending from the central axis L to the actual leading point.

However, it is emphasized that, during operation, the actual feed moving direction may significantly differ from the (imaginary) ideal moving direction 28. Therefore, it should be understood that it is quite likely during operation that the axial moving direction is not perfectly perpendicular to the lateral direction Y or the tangential direction t and, consequently, not perfectly parallel to the longitudinal direction X.

Returning to the linear embodiment of the blade set 20 shown in FIGS. 2-13, further reference is made to FIG. 3 illustrating a drive engagement member 26 that may be coupled to the movable blade 24 for driving the movable blade 24 in the cutting direction 30. To this end, the drive engagement member 26 may be attached or fixed to the movable blade 24. When the blade set 20 is attached to the cutting appliance 10, the drive engagement member 26 may be coupled to the drive mechanism 16 so as to be driven by the motor 16 during operation.

Figure 4:
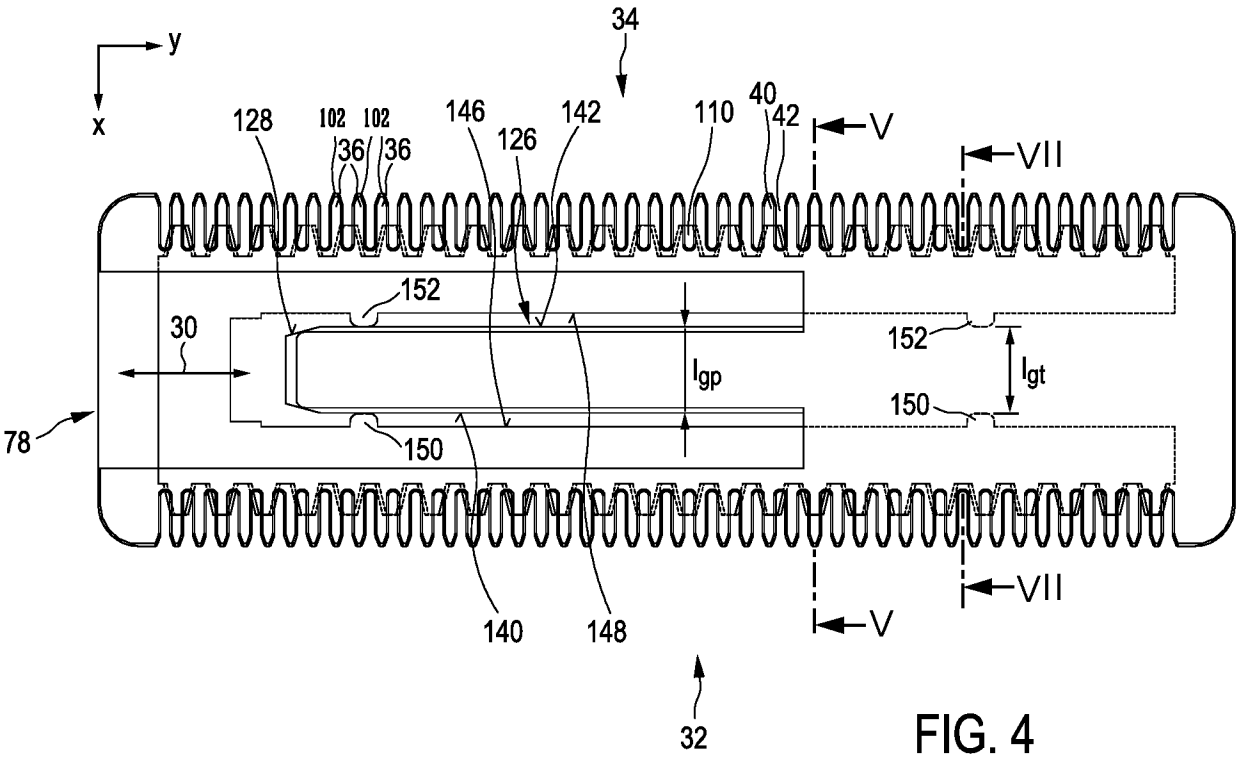
FIG. 4 is a top view of the blade set shown in FIG. 2.
Figure 18:
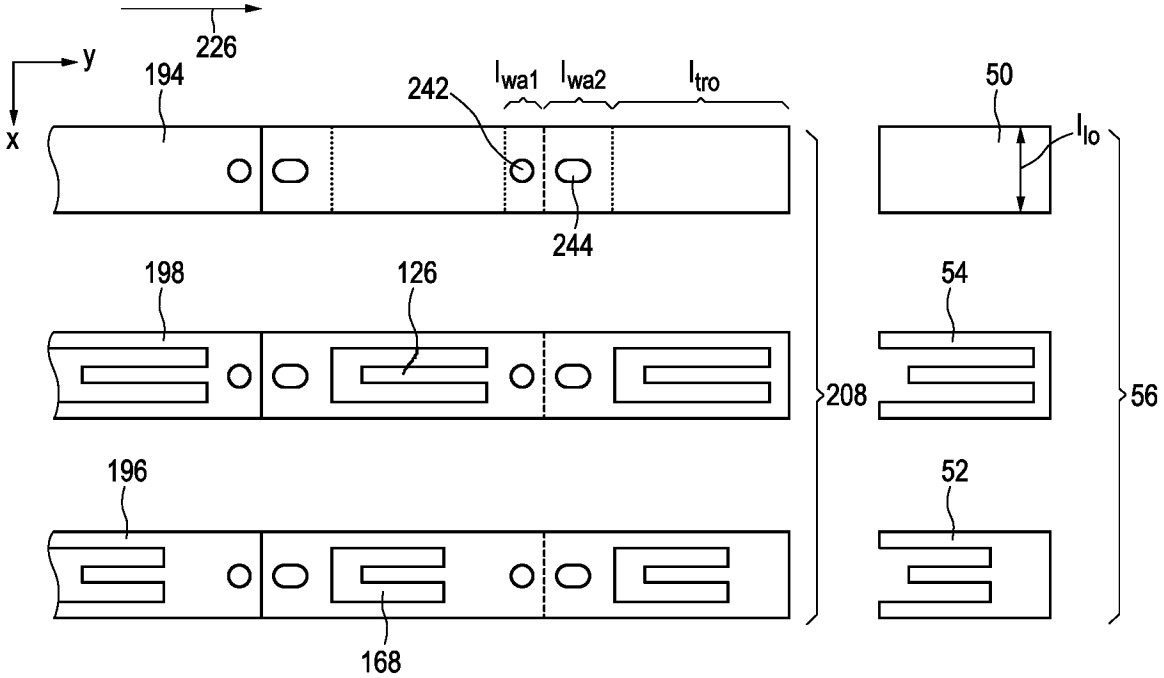
FIG. 18 illustrates a simplified schematic top view of several intermediate strips from which a stationary blade in accordance several aspects of the present disclosure can be formed, the intermediate strips being shown in a mutually separated state, primarily for illustrative purposes.

As can be best seen in FIG. 4, the blade set 20 may basically comprise a rectangular shape or outline, when viewed in a top view perpendicular to the height direction Z, refer to FIGS. 2 and 3. The stationary blade 22 may comprise at least one leading edge 32, 34 at a longitudinal end. More specifically, the at least one leading edge 32, 34 may also be referred to as at least one toothed leading edge 32, 34 for the purpose of this disclosure. In accordance with the embodiment shown in FIG. 4, the stationary blade 22 comprises a first leading edge 32 and a second leading edge 34, the first leading edge 32 and the second leading edge 34 opposing each other. Each of the leading edges 32, 34 may be provided with a plurality of projections 36 and respective slots therebetween. In some embodiments, the projections 36 may substantially project in the longitudinal dimension X (or: the radial dimension r). In other words, the longitudinal extension of the projections 36 may be considerably greater than their width extension along the transverse or lateral direction Y (or: the tangential direction t). For illustrative purposes, but not to be understood in a limiting way, the projections 36 may be referred to in the following as longitudinally extending projections 36. The longitudinally extending projections 36 may comprise respective outwardly facing tips 102. The longitudinally extending projections 36 may define respective teeth 40 of the stationary blade 22. Along the respective leading edge 32, 34, the teeth 40 may alternate with respective tooth spaces 42. An exemplary embodiment of the blade set 20 may comprise an overall longitudinal dimension $l_{lo}$ in the range of about 8 mm to 15 mm, preferably in the range of about 8 mm to 12 mm, more preferably in the range of about 9.5 mm to 10.5 mm. The blade set 20 may comprise an overall lateral extension $l_{to}$ in the range of about 25 mm to 40 mm, preferably in the range of about 27.5 mm to 37.5 mm, more preferably in the range of about 31 mm to 34 mm. Refer also to FIG. 18 in this regard. However, this exemplary embodiment shall not be construed as limiting the scope of the overall disclosure.

Figure 5:
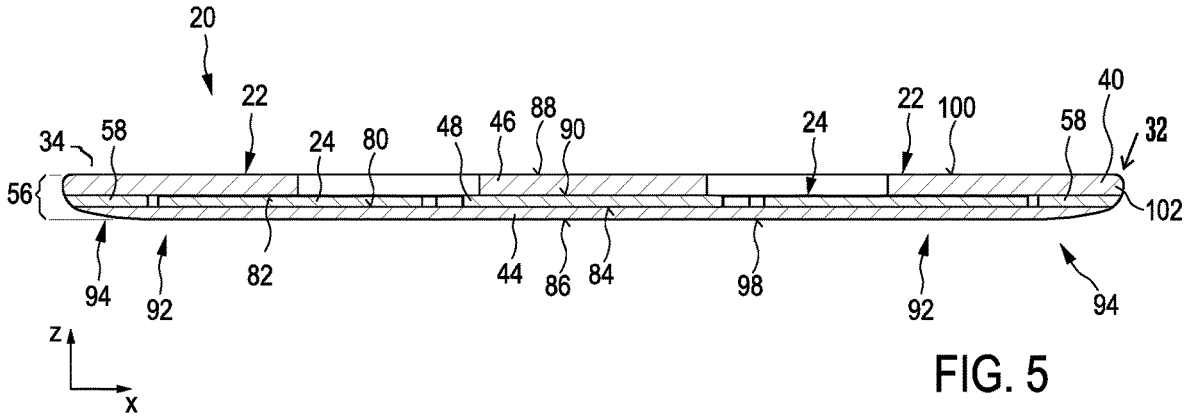
FIG. 5 is a cross-sectional side view of the blade set shown in FIG. 2 along the line V-V of FIG. 4.
Figure 6:
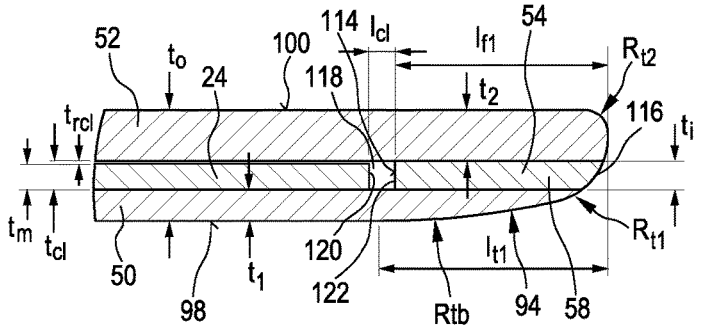
FIG. 6 is an enlarged detailed view of the blade set shown in FIG. 5 at a leading edge thereof.

The blade sets 20, 20*a* in accordance with the present disclosure provide for wide applicability, preferably covering both shaving and trimming (or: clipping) operations. This may be attributed, at least in part, to a housing functionality of the stationary blade 22 that may at least partially enclose and accommodate the movable blade 24. With further reference to FIGS. 5 and 6, a cross-sectional side view of the blade set 20 along the line V-V in FIG. 4, and a respective detailed view, are shown and explained hereinafter. As can be seen in FIG. 5, the stationary blade 22 may comprise a first wall portion 44, a second wall portion 46 and, disposed therebetween, an intermediate wall portion 48. While it is acknowledged in connection with FIGS. 5 and 6 that the hatching of the respective wall portions 44, 46, 48 may indicate that the stationary blade 22 necessarily has to be composed of distinct layers or slices, it should be noted that in some embodiments the stationary blade 22 indeed may be composed of a single integral part forming the first wall portion 44, the second wall portion 46 and the intermediate wall portion 48. Alternatively, in some embodiments, the stationary blade 22 may be composed of two distinct parts, wherein at least one of the parts may form at least two of the first wall portion 44, the second wall portion 46 and the intermediate wall portion 48. Furthermore, it is worth to be noted that in some alternative embodiments at least one of the first wall portion 44, the second wall portion 46 and the intermediate wall portion 48 may be composed of two or even more layers or segments.

Figure 11:
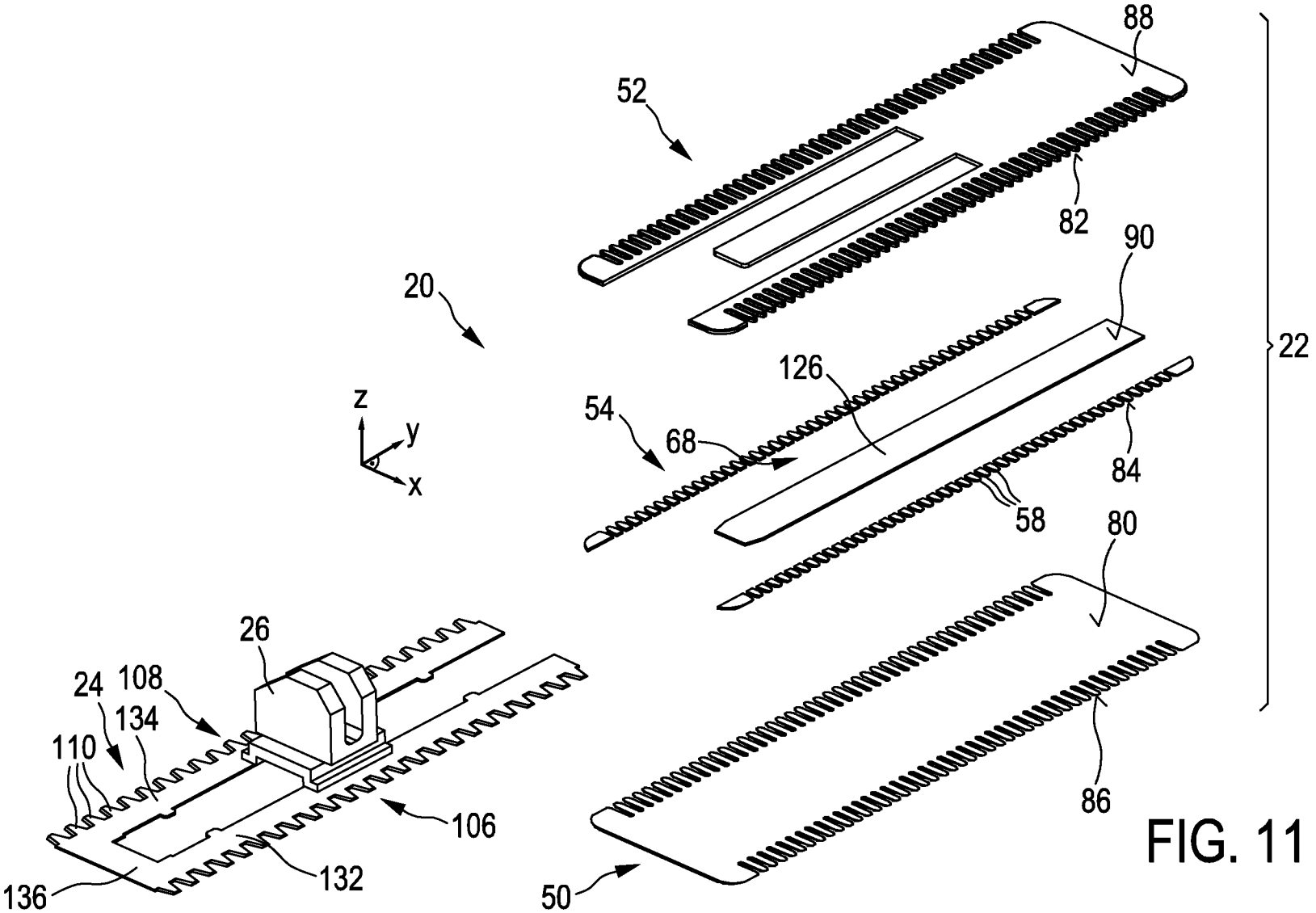
FIG. 11 shows a perspective exploded top view of the blade set of FIG. 2.

As used herein, the term first wall portion 44 may typically refer to the wall portion of the stationary blade 22 that is facing the skin during operation of the cutting appliance 10. Consequently, the second wall portion 46 may be regarded as the wall portion of the stationary blade 22 facing away from the skin during operation, and facing the housing 12 of the cutting appliance 10. With continuing reference to FIG. 4, and particular reference to the exploded view of FIG. 11, an advantageous embodiment of the stationary blade 22 is described. FIG. 11 shows an exploded perspective view of the blade set 20, refer also to FIG. 3. As can be seen in FIG. 11, in a preferred embodiment, the first wall portion 44 may be formed by a first wall segment 50, particularly by a first layer 50. The first layer 50 may be regarded as skin-facing layer. The second wall portion 46 may be formed by a second wall segment 52, particularly by a second layer 52. The second layer 52 may be regarded as a layer facing away from the skin during operation. The intermediate wall portion 48 may be formed by an intermediate wall segment 54, particularly by an intermediate layer 54. When assembled and fixed together, the intermediate layer 54 is disposed between the first layer 50 and the second layer 52.

As can be best seen in FIG. 11, the intermediate layer 54 does not necessarily have to be a single, integrated part. Instead, at least at an advanced manufacturing state, at least the intermediate layer 54 may be composed of a plurality of separated sub-parts, which will be shown and discussed further below in more detail. When taken together, e.g., when fixedly interconnected, the first layer 50, the second layer 52 and the intermediate layer 54 may define a segmented stack 56, more preferably, a layered stack 56. In an exemplary embodiment, the layered stack 56 may be regarded as a triple-layered stack 56. Forming the stationary blade 22 of a plurality of wall portions 44, 46, 48 or, preferably, of a plurality of layers 50, 52, 54 basically allows to make use of distinct single portions or layers of different type and shape. For instance, with particular reference to FIG. 6, a height dimension $t_1$ of the first wall portion 44 (or: layer 50), which also may be referred to as (average) thickness $t_1$, may be different from a respective height dimension $t_2$ of the second wall portion 46 (or: second layer 52), which also may be referred to as (average) thickness $t_2$, and different from a height dimension $t_i$ of the intermediate wall portion 48 (or: the intermediate layer 54), which also may be referred to as (average) thickness $t_1$. This is particularly beneficial since in this way each of the wall portions 44, 46, 48 (or: layers 50, 52, 54) may have distinct characteristics and a distinct shape suitably adapted to an intended function.

For instance, the thickness $t_2$ may be considerably greater than the thickness $t_1$. In this way, the second wall portion 46 (or: second layer 52) may serve as a stiffening member and provide considerable rigidity. Consequently, the first wall portion 44 (or: first layer 50) may become considerably thinner without making the stationary blade 22 too flexible. Providing a particularly thin first wall portion 44 (or: first layer 50) permits cutting of hairs close to the skin, preferably, at the skin level. In this way, a smooth shaving experience may be achieved. An overall height dimension $t_o$ of the stack 56 is basically defined by the respective partial height dimensions $t_1$, $t_2$, $t_i$. It is worth to be noted in this connection that, in some embodiments, the thickness $t_1$ of the first wall portion 44 (or: first layer 50) and the thickness $t_2$ of the second wall portion 46 (or: second layer 52) may be the same or, at least, substantially the same. In even yet another embodiment, also the thickness $t_i$ of the intermediate wall portion 48 (or: intermediate layer 54) may be the same.

By way of example, the thickness $t_1$, at least at the at least one leading edge 32, 34, may be in the range of about 0.04 mm to 0.25 mm, preferably in the range of about 0.04 mm to 0.18 mm, more preferably in the range of about 0.04 mm to 0.14 mm. The thickness $t_2$, at least at the at least one leading edge 32, 34, may be in the range of about 0.08 mm to 0.4 mm, preferably in the range of about 0.15 mm to 0.25 mm, more preferably in the range of about 0.18 mm to 0.22 mm. The thickness $t_i$, at least at the at least one leading edge 32, 34, may be in the range of about 0.05 mm to about 0.5 mm, preferably of about 0.05 mm to about 0.2 mm. The overall thickness to, at least at the at least one leading edge 32, 34, may be in the range of about 0.3 mm to about 0.75 mm, preferably in the range of about 0.4 mm to 0.5 mm.

It is generally preferred in some embodiments, that the first wall portion 44 may have an average thickness $t_1$ that is less than an average the thickness $t_2$ of the second wall portion 46, at least at the longitudinal projection portions thereof at the leading edge 32, 34. It is further noted that not all embodiments of the stationary blade 22, 22*a* of the present disclosure need to include a second wall 46 having an average thickness $t_2$, at least at the leading edge thereof, that is greater than an average thickness $t_1$ of the first wall portion 44, at least at the leading edge thereof.

With continuing reference to FIG. 5 at least one filled region 58 at the at least one leading edge 32, 34 of the stationary blade 22 is shown. The filled portion 58 may be regarded as the portion of the intermediate wall portion 48 (or: intermediate layer 54) that connects the first and second wall portions 44, 46 (or: layers 50, 52) at their leading edges 32, 34. As can be seen in FIGS. 5, 6, 10 and 11, at least in a finished state, the filled region 58 may be composed of a plurality of sub portions which may correspond to the number of teeth 40 at the respective leading edge 32, 34. Adjacent to the filled region 58 at the leading edges 32, 34, at least one housing region 92 may be provided, where the stationary blade 22 at least partially encompasses the movable blade 24. In other words, at least one guide slot 76 (refer particularly to FIGS. 3, 9, 10 and 16*c*) can be defined that may serve as a guided pathway for the movable blade 24 when being driven by the motor 14 of the cutting appliance 10 during cutting operation. As can be best seen in FIGS. 10, 11, 16*a* and 16*c*, the guide slot 76 may be basically defined by a cut-out portion 68 in the intermediate wall portion 48 (or: the intermediate layer 54). In some embodiments, the cut-out portion 68 extends to a lateral or transverse end of the stationary blade 22, thereby defining a lateral opening 78, through which the movable blade 24 may be inserted into the stationary blade 22 during manufacturing, refer also to FIGS. 9 and 10.

The guide slot 76 may define a linear pathway for the movable blade 24 of the exemplary linear embodiment of the blade set 20 illustrated in FIGS. 2-13. However, with reference to the curved or circular embodiment of the blade set 20*a* shown in FIGS. 14, 15*a* and 15*b*, the guide slot 76 may also define a curved pathway, particularly a circumferentially extending pathway for a respective (curved or circular) movable blade 24.

Returning to FIG. 5, and further referring to FIG. 11, basically laterally and longitudinally extending surfaces 80, 82 84, 86, 88 and 90 of the stationary blade will be described. For ease of reference, the terms first layer 50, second layer 52 and intermediate layer 54 will be used hereinafter for describing the general layout of the stationary blade 22. However, this shall not be construed in a limiting way, it is therefore emphasized that the term layer may be optionally replaced by the alternative terms wall portion and wall segment, respectively.

The first layer 50, facing the skin during operation, may comprise a first surface 80 facing away from the skin and a second surface 86 facing the skin. The second layer 52 may comprise a second surface 88 facing away from the skin and a first surface 82 facing the skin and the first layer 50. The intermediate layer 54 may comprise a first surface 84 facing the first layer 50 and a second surface 90 facing the second layer 52. The respective first surfaces 80, 82 of the first layer 50 and the second layer 52 may at least partially cover the cut-out portion 68 in the intermediate layer and define the at least one housing region 92 and, consequently, the guide slot 76 for the movable blade 24.

At the at least one leading edge 32, 34, particularly at the skin-facing second surface 86 of the first layer 50 of the stationary blade 22, at least one transitional region 94 may be provided that can be referred to as smoothed transitional region 94. Since the exemplary illustrative embodiment of the stationary blade 22 shown in FIGS. 5 and 6 comprises, at each longitudinal end, a respective leading edge 32, 34, two respective transitional regions 94 may be provided. The at least one transitional region 94 may enhance slidability characteristics of the blade set 20 when being moved along the moving direction 28 through hair over the skin for cutting hair. Particularly, the at least one transitional region 94 may prevent the blade set 20, particularly the leading edge 32, 34 thereof which is used for cutting, from deeply dipping into skin portions when sliding along the skin. Skin irritation can be diminished in this way. Preferably, also skin incision appearances can be avoided or, at least, reduced to a great extent in this way. The transitional region 94 may be connected to and extending from a substantially flat region 98 of the first layer 50. This substantially flat region 98 may be regarded as a basically planar-shaped portion of the second surface 86 of the first layer 50. In general, as used herein, the term substantially flat may involve a planar shape, but also slightly uneven surfaces. It is worth mentioning that the substantially flat region 98 may comprise perforations, small recesses, etc., that do not substantially impair the overall flat or planar shape. In some embodiments, the substantially flat region 98 may involve a planar surface. This applies in particular when at least the first layer 50 is originally provided as sheet or sheet-like material. The transition region 94 may span a considerable portion of the leading edge 32. Particularly, the transitional region 94 may connect the substantially flat region 98 at the first layer 50 and a substantially flat region 100 at the second layer 52. Also the substantially flat region 100 may be shaped as a flat or planar region, but may also be provided with (minor) perforations or recesses, that do not impair the overall flat shape thereof.

As can be best seen in FIG. 4, see the line V-V, the cross section illustrated in the FIGS. 5 and 6 includes a longitudinal cross section through a tip 102 of the teeth 40 of the leading edges 32, 34. Consequently, also the transitional region 94 may be primarily formed at the teeth 40 of the toothed leading edge 32, 34. The transitional region 94 may comprise a longitudinal extension $l_{tl}$ between tooth tips 102 of the stationary blade 22 and the substantially flat region 98. By way of example, the longitudinal extension $l_{tl}$ may be in the range of about 0.5 mm to about 1.5 mm, preferably in the range of about 0.6 mm to about 1.2 mm, more preferably in the range of about 0.7 mm to about 0.9 mm. Moreover, the transitional region 94 may comprise several sections. As can be seen in FIGS. 5 and 6, the transitional region 94 may comprise a substantially convex surface tangentially merging into the substantially flat region 98 and the substantially flat region 100. Furthermore, the transitional region 94 does not protrude over the substantially flat region 98 (i.e., in the height direction Z). In other words, the transitional region 94 may extend rearwardly from the substantially flat region 98 towards the second layer 52. The transitional region 94 may at least partially extend away from the substantially flat region 98 in the height direction Z.

As can be best seen in FIG. 6, the transitional region 94 may comprise a bottom radius $R_{tb}$. By way of example, the bottom radius $R_{tb}$ may be in the range of about 1.0 mm to about 5.0 mm, preferably in the range of about 2.0 mm to about 4.0 mm, more preferably in the range of about 2.7 mm to about 3.3 mm. Furthermore, a tip rounding 116 may be provided which may involve at least one edge radius. Particularly, the tip rounding 116 may comprise a first edge rounding $R_{t1}$, and a second edge rounding $R_{t2}$. By way of example, the first edge rounding $R_{t1}$ may be in the range of about 0.10 mm to about 0.50 mm, preferably in the range of about 0.15 mm to about 0.40 mm, more preferably in the range of about 0.20 mm to about 0.30 mm. By way of example, the second edge rounding $R_{t2}$ may be in the range of about 0.03 mm to about 0.20 mm, preferably in the range of about 0.05 mm to about 0.15 mm, more preferably in the range of about 0.07 mm to about 0.10 mm. The bottom radius $R_{tb}$, the first edge rounding $R_{t1}$, and the second edge rounding $R_{t2}$ may tangentially merge into each other. However, in the alternative or additionally, respective straight portions may be provided therebetween that may be also tangentially connected to the respective radii. The bottom radius $R_{tb}$ may merge tangentially into the substantially flat region 98. The second edge rounding $R_{t2}$ may merge tangentially into the substantially flat region 100.

Figure 7A:
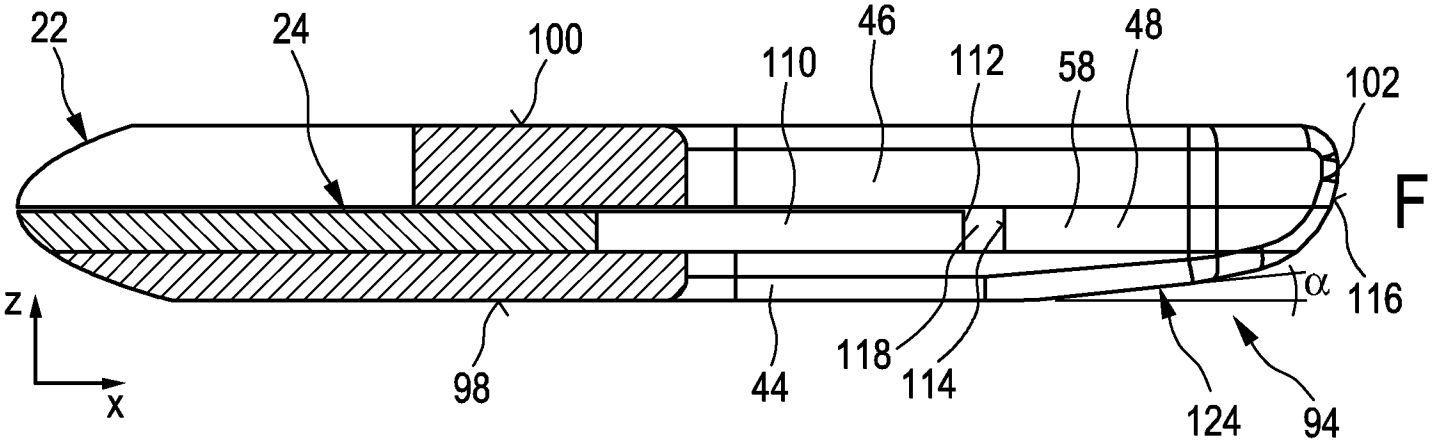
FIG. 7*a* is a cross-sectional side view of an alternative embodiment of the blade set shown in FIG. 2 along the line VII-VII in FIG. 4.
Figure 8:
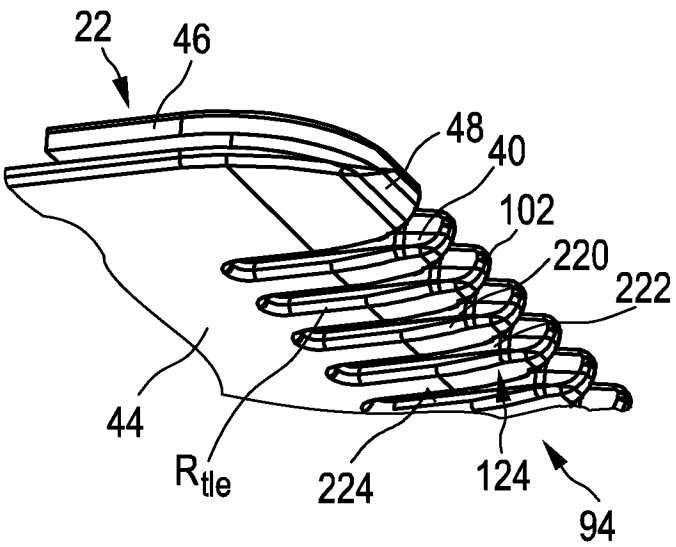
FIG. 8 is a partial perspective bottom view of the blade set shown in FIGS. 7*a* and 7*b* showing a portion of a leading edge thereof including several teeth.
Figure 7B:
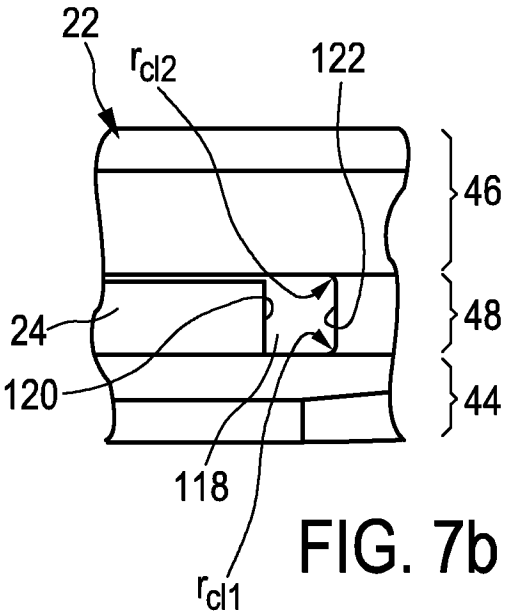
FIG. 7*b* is an enlarged detailed view of the blade set shown in FIG. 7*a* at a clearance portion between the stationary blade and the movable blade thereof.
Figure 9:
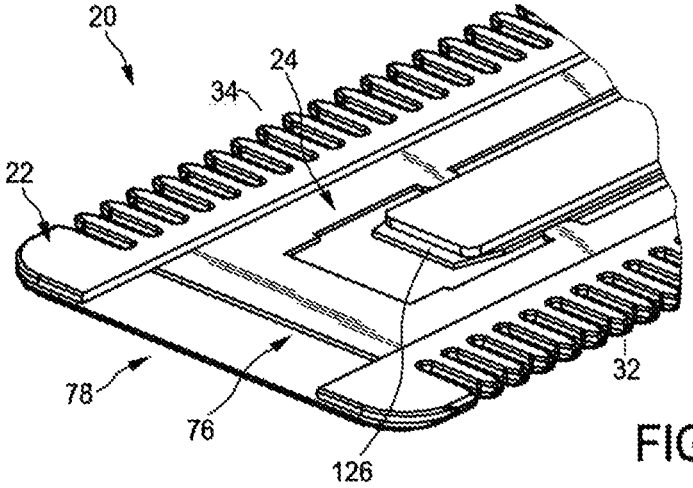
FIG. 9 is a partial perspective top view of the blade set shown in FIG. 2 illustrating a lateral end thereof comprising a lateral opening.
Figure 10:
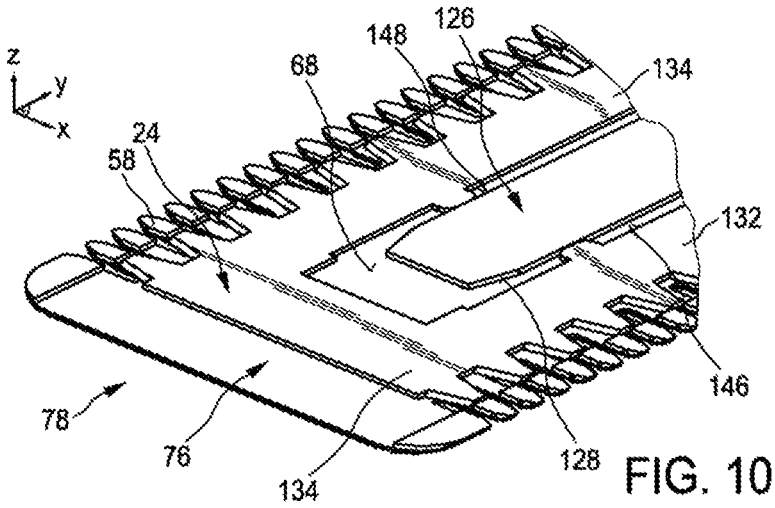
FIG. 10 is a further partial perspective top view corresponding to the view of FIG. 9, a wall portion of the stationary blade being omitted merely for illustrative purposes.

However, as can be best seen in FIGS. 7*a* and 8, the transitional region 94 may be also provided with a bevelled section 124 that may replace or complement the bottom radius $R_{tb}$. The bevelled section 124 may comprise a chamfer angle α (alpha) relative to a horizontal plane that is substantially parallel to the longitudinal direction X and the transverse direction Y, wherein the chamfer angle α may be in the range of about 25° to 35°. Preferably, the bevelled section merges tangentially into the substantially flat region 98. Even more preferred, the bevelled section 124 tangentially merges into the tip rounding 116. As can be seen in FIG. 4, refer to the line VII-VII, FIG. 7*a* shows a partial cross-sectional view of the blade set 20 that involves a tooth space 42.

In other words, the transitional region 94 may also comprise a combination of the bottom radius $R_{tb}$ and the beveled section 124. In other words, the bottom radius $R_{tb}$ may serve as a tangential transition between the substantially flat region 98 and the bevelled section 124 including the chamfer angle α. At a longitudinal end-facing end thereof, the bevelled section 124 may tangentially merge into the tip rounding 116 which may be defined, for instance, by the first edge rounding $R_{t1}$ and the second edge rounding $R_{t2}$ that were described further above.

With further reference to FIG. 11 and to FIG. 4, the layout of the movable blade 24 is further detailed and described. Also the movable blade 24 may be provided with at least one leading edge. As indicated by the exemplary embodiment of the blade set 20 shown in FIGS. 4 and 11, the movable blade 24 may comprise a first leading edge 106 and a second leading edge 108. Each of the leading edges 106, 108 may be provided with a plurality of teeth 110. It goes without saying that in some embodiments of a blade set 20 adapted for enabling relative cutting motion between the movable blade 24 and the stationary blade 22, only one stationary blade leading edge 32 and a respective single movable blade leading edge 106 may be provided. However, for many applications the configuration of the blade set 20 involving two leading edges 32, 34 at the stationary blade 22 and two corresponding leading edges 106, 108 at the movable blade 24 may be particularly beneficial since in this way the cutting appliance 10 may become more flexible and permit even further cutting operations, e.g., back and forth motion at the skin along the moving direction 28 which may improve cutting performance. In other words, the embodiment of the blade set 20 illustrated in FIGS. 2-13 may generally involve a single-sided layout comprising a single cutting edge at only one longitudinal end of the blades 22, 24, or a double-sided layout comprising two generally opposing cutting edges mutually defined by the respective leading edges 32, 34 and 106, 108.

Figure 12:
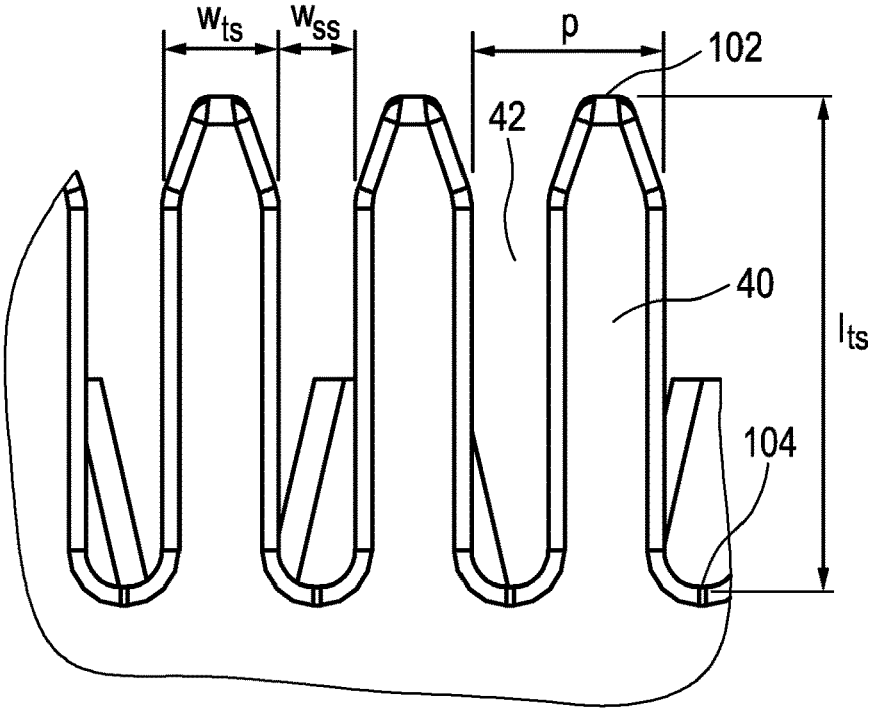
FIG. 12 shows a detailed top view of the stationary blade shown in FIG. 4 at a leading edge thereof comprising several teeth.
Figure 13:
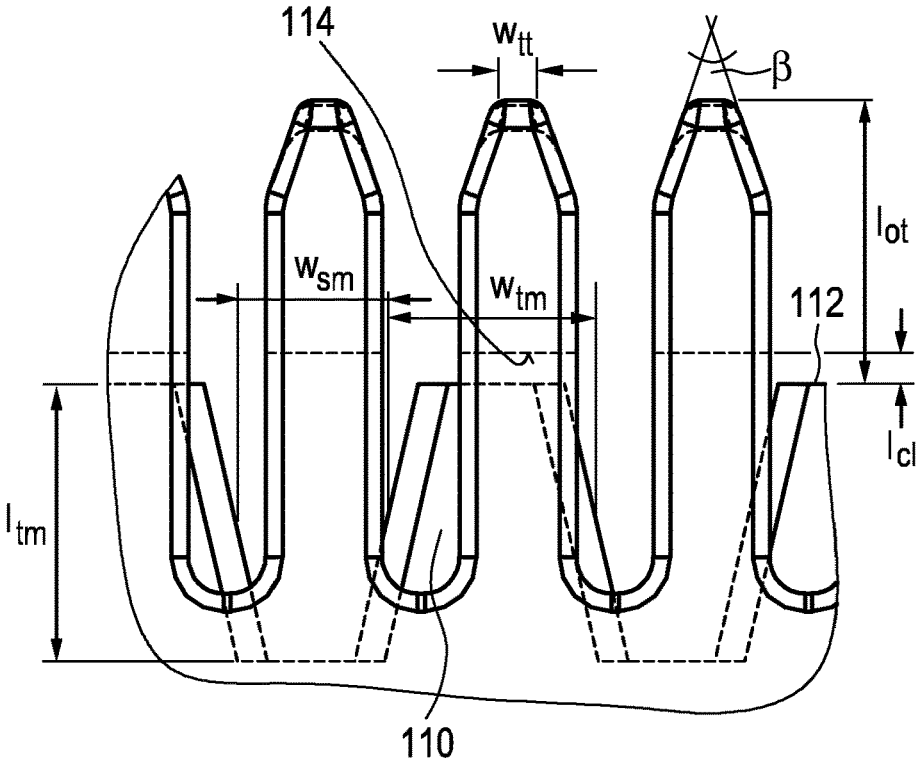
FIG. 13 shows a detailed top view of the blade set in accordance with FIG. 12, whereas hidden contours are indicated by dashed lines primarily for illustrative purposes.

With reference to FIGS. 12 and 13, relevant dimensions of the teeth 40 of the stationary blade 22 and the teeth 110 of the movable blade 24 will be described. FIG. 12 illustrates a partial enlarged top view of a toothed portion of the blade set 20, whereas FIG. 13 further details the view shown in FIG. 12 by indicating hidden edges by dashed lines. The teeth 40 of the stationary blade 22 are arranged at a pitch dimension p. By way of example, the pitch p may be the range of about 0.4 mm to about 1.0 mm, preferably in the range of about 0.5 mm to about 0.8 mm, more preferably in the range of about 0.6 mm to about 0.7 mm. The teeth 40 further comprise a lateral extension $w_{ts}$. By way of example, the lateral extension $w_{ts}$ may be in the range of about 0.25 mm to 0.60 mm, preferably in the range of about 0.30 mm to about 0.50 mm, more preferably in the range of about 0.35 mm to 0.45 mm. The tooth spaces 42 of the stationary blade comprise a lateral extension $w_{ss}$. By way of example, the lateral extension $w_{ss}$ may be in the range of about 0.15 mm to 0.40 mm, preferably in the range of about 0.20 mm to about 0.33 mm, more preferably in the range of about 0.25 mm to 0.28 mm. The teeth 40 further comprise a longitudinal extension $l_{ts}$ between their tips 102 and a respective tooth base 104. By way of example, the longitudinal extension $l_{ts}$ may be in the range of about 0.6 mm to 2.5 mm, particularly in the range of about 1.0 mm to 2.0 mm, more particularly in the range of about 1.5 mm to 2.0 mm.

Correspondingly, the teeth 110 of the movable blade 24 may comprise a longitudinal dimension $l_{tm}$, an (average) lateral tooth extension $w_{tm}$, and an (average) lateral tooth space extension $w_{sm}$. By way of example, the longitudinal extension $l_{tm}$ may be in the range of about 0.15 mm to 2.0 mm, preferably in the range of about 0.5 mm to about 1.0 mm, more preferably in the range of about 0.5 mm to 0.7 mm. Furthermore, between the tips 102 of the teeth 40 of the stationary blade 22 and tips 112 of the teeth 110 of the movable blade 24, a longitudinal offset dimension $l_{ot}$ is defined. By way of example, the longitudinal offset dimension $l_{ot}$ may be in the range of about 0.3 mm to 2.0 mm, preferably in the range of about 0.7 mm to about 1.2 mm, more preferably in the range of about 0.8 mm to 1.0 mm. As can be seen in top view, as shown in FIG. 13, the tips 102 of the teeth 40 of the stationary blade 22 may comprise a taper angle β (beta). Between respective legs of the taper angle β, at the end of the tip 102, a blunt tip portion may be provided comprising a lateral tooth tip width $w_{tt}$. In some embodiments, the taper angle β of the tips 102 may be in the range of about 30° to 50°, more preferably in the range of about 35° to 45°, even more preferably in the range of about 38° to 42°. The lateral width of the tool tips 102 may be in the range of about 0.12 mm to 0.20 mm, preferably in the range of about 0.14 mm to 0.18 mm.

Returning to FIGS. 5 and 6, a further beneficial aspect of the segmented structured shape of the blade set 20 is illustrated and described in more detail. As can be best seen in FIG. 6, where a tooth 110 of the movable blade 24 and a tooth 40 of the stationary blade 22 are aligned (see also line V-V in FIG. 4), a defined clearance portion 118 is provided between an inwardly facing end face 114 of the stationary blade filling 58 and the tips 112 of the teeth 110 of the movable blade 24, refer also to FIG. 13. The clearance portion 118 comprise a clearance longitudinal dimension $l_{cl}$ and a clearance height dimension $t_{cl}$. The clearance longitudinal dimension $l_{cl}$ and the clearance height dimension $t_{cl}$ are suitably defined so as to prevent hair from entering the clearance portion 118, at least with a high probability. If, for instance, sufficient space would be provided to allow single hairs to easily enter the gap between the tips 112 of the teeth 110 of the movable blade 24 and the end face 114 of the stationary blade filling 58, such hairs might be blocked or jammed there. This might impair the cutting performance. Furthermore, blocked hairs are likely to be torn out rather than being cut. This is often experienced as uncomfortable or even painful and might irritate the skin. It is therefore particularly preferred that the (longitudinal and lateral) space provided by the clearance portion 118 is smaller than an expected diameter of a to-be-cut hair. In this way, the risk of blockages caused by entered hairs in the clearance portion 118 can be significantly reduced. It might be sufficient in many cases that at least one of the clearance longitudinal dimension $l_{cl}$ and the clearance height dimension $t_{cl}$ is smaller than the diameter of a to-be-expected hair. By way of example, the longitudinal dimension $l_{cl}$ may be less than 0.5 mm, preferably less than 0.2 mm, more preferably less than 0.1 mm. By way of example, the height dimension $t_{cl}$, perpendicular to the longitudinal dimension $l_{cl}$, may be in the range of about 0.05 mm to about 0.5 mm, preferably of about 0.05 mm to about 0.2 mm.

The clearance portion 118 may be composed of a backward portion 120, adjacent to the tips 112 of the teeth 110 of the movable blade 24, and a front portion 122 at the end face 114 of the stationary blade filled region 58. As can be best seen in FIG. 7*b*, which is a detailed view of the illustration provided in FIG. 7*a* showing the clearance portion 118, the front portion 122 of the clearance portion 118 may comprise at least one transition radius $r_{cl1}$, $r_{cl2}$. In this embodiment, the radius $r_{cl1}$ may connect the intermediate layer 54 and the first layer 50. The radius $r_{cl2}$ may connect the intermediate layer 54 and the second layer 52. By way of example, the radii $r_{cl1}$ and $r_{cl2}$ may be in the range of about 0.025 mm to about 0.25 mm, preferably of about 0.025 mm to about 0.1 mm.

Returning to the embodiment illustrated in FIGS. 5 and 6, it is elucidated that the layered structure of the layered stack 56 forming the stationary blade 22 may be particularly beneficial, since in this way the longitudinal dimension $l_{cl}$ and the height dimension $t_{cl}$ of the clearance portion 118 are selectable in wide ranges. By providing the stationary blades 22 as a layered stack 56 or, more generally, as a segmented stack, tight tolerances may be achieved that cannot be achieved when applying prior art blade set structures. As can be further seen in FIG. 6, the filled region 58 at the leading edge 32, 34 of the stationary blade 22 may comprise a longitudinal extension $l_{f1}$. By way of example, the longitudinal extension $l_{f1}$ may be in the range of about 0.6 mm to 1.2 mm, preferably in the range of about 0.75 mm to 0.9 mm, more preferably in the range of about 0.8 mm to about 0.85 mm. Since each of the layers 50, 52, 54 of the layered stack 56 can be widely customized with respect to geometric properties, the stationary blade 22 can be shaped in a way that cannot be achieved when using prior art blade set structure approaches.

The clearance height dimension $t_{cl}$ may basically correspond to the height dimension $t_i$ of the intermediate layer 54. Since the height $t_i$ of the intermediate layer 54 can be defined and selected accurately, further having close tolerances, even a clearance fit mating of the movable blade 24 in the guide slot 76 in the stationary blade 22 may be achieved, at least in the height direction Z. The clearance height dimension $t_{cl}$ defined by the height dimension $t_i$ of the intermediate layer 54, and the height dimension $t_m$ of the movable blade 24, at least in a region thereof that is guided in the guide slot 76, can be defined precisely with narrow design tolerances, such that the movable blade 24 is properly guided in the guide slot 76 for smooth-running without rattling (excessive loose fit) or jamming (excessive tight fit). A resulting assembly clearance height dimension $t_{rcl}$ is indicated in FIG. 6 and basically defined by the clearance height dimension tai of the guide slot 76 and the height dimension $t_m$ of the movable blade 24. By way of example, the clearance height dimension $t_{rcl}$ may be in the range of about 0.003 mm to about 0.050 mm, preferably in the range of about 0.005 mm to about 0.030 mm.

As can be best seen in FIGS. 4, 11 and 16*a*-16*c*, the cut-out portion 68 in the intermediate layer 54 may further define an inner guide portion 126 for guiding the movable blade 24 when moving along the lateral direction Y (or: tangential direction t). The inner guide portion 126 may be formed as a tab or strip. The inner guide portion 126 may be basically arranged at a longitudinal central portion of the stationary blade 22. At an end of the inner guide portion 126, adjacent to the lateral opening 78, a tapered portion 128 may be provided, refer also to FIG. 9 and FIG. 10. The tapered portion 128 may facilitate the mounting or insertion step for the movable blade 24.

With particular reference to FIG. 11, the structure of the movable blade 24 of an exemplary embodiment in accordance with the present disclosure is further described and detailed. When viewed in top view (refer to FIG. 4), the movable blade 24 may be basically U-shaped, comprising a first arm portion 132 associated with the first leading edge 106, a second arm portion 134 associated with the second leading edge 108, and a connector portion 136 connecting the first arm portion 132 and the second arm portion 134. By way example, the connector portion 136 may be provided at a lateral end of the movable blade 24 and, when mounted in the stationary blade 22, arranged in the vicinity of the lateral opening 78 of the stationary blade 22. In other words, the first arm portion 132 and the second arm portion 134 may be arranged in parallel at a distance in the longitudinal direction X that is adapted to a longitudinal extension of the inner guide portion 126 in the intermediate layer 54. For guiding the movable blade 24, the inner guide portion 126 may comprise a first laterally extending guide surface 140 and a second laterally extending guide surface 142, refer to FIG. 4. Correspondingly, the movable blade 24 may comprise respective inwardly facing contact portions 146, 148 at respective arm portions 132, 134 thereof.

In some embodiments, the at least one guide portion 146, 148 arranged at the at least one arm portion 132, 134 of the movable blade 24 may be provided with at least one contact element 150, 152, particularly with at least one guiding tab 150, 152. By way of example, the movable blade 24 shown in FIG. 4 (in a partially hidden mode) may comprise two guiding tabs 150 at the first contact portion 146 at the first arm portion 132. The movable blade 24 may further comprise two guiding tabs 152 at the second contact portion 148 of the second arm portion 134 thereof. The laterally extending guide surface 140, 142 of the inner guide portion 126 may be spaced apart by a longitudinal extension $l_{gp}$. Correspondingly, the at least one first contact element 150 (or: guiding tab) and the at least one second contact element 152 (or: guiding tab) may be spaced apart by a longitudinal clearance dimension $l_{gt}$. It is preferred that the longitudinal clearance dimension $l_{gt}$ of the guiding tabs 150, 152 is selected to be slightly larger than the longitudinal extension $l_{gp}$ of the inner guide portion 126. In this way, defined clearance fit guidance for the movable blade 24 enabling a smooth relative cutting motion may be achieved. By way of example, a resulting clearance longitudinal dimension defined by the longitudinal extension $l_{gp}$ and the longitudinal clearance dimension $l_{gt}$ may be in the range of about 0.003 mm to about 0.050 mm, preferably in the range of about 0.005 mm to about 0.030 mm. It is particularly preferred in some embodiments that the guide slot 76 in the stationary blade 22 provides for form-locked guidance of the movable blade 24 in the longitudinal dimension X and in the height (or: vertical) dimension Z, thereby allowing for smooth running along the lateral direction Y. Needless to say, the above-described beneficial principles may be readily transferred to the circular or, more generally, curved embodiment of the blade set 20*a* shown in FIGS. 14, 15*a* and 15*b*.

With particular reference to FIGS. 15*a* and 15*b*, the stationary blade 22*a* of the (circular) blade set 20*a* is further detailed. In the cross-sectional view provided in FIG. 15*b* a hatching is shown and indicates that the stationary blade 22*a* may be formed as an integral part. However, also the stationary blade 22*a* may comprise a first wall portion 44, a second wall portion 46 and an intermediate wall portion 48 that mutually define a guide slot 76 for a respective movable blade. It should be further noted in this connection that the stationary blade 22*a* may also comprise a layered structure in accordance with the above-described principles of several beneficial embodiments of the (linear) blade set 20 and its respective stationary blade 22. Consequently, each of the first wall portion 44, the second wall portion 46 and the intermediate wall portion 48 may be formed by a respective wall segment or layer. As mentioned above, terms such as longitudinal may be regarded as radial in connection with the circular embodiment. Further, terms such as lateral or transverse may be regarded as tangential or circumferential in connection with the circular embodiment.

Figure 16A:
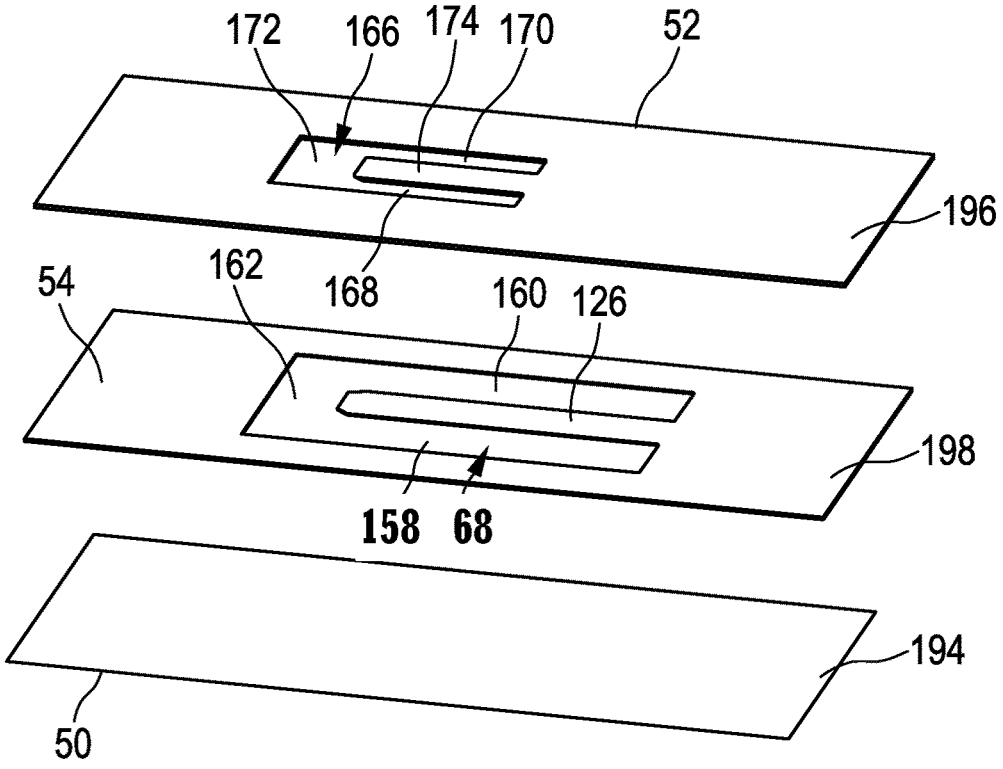
Figure 16B:
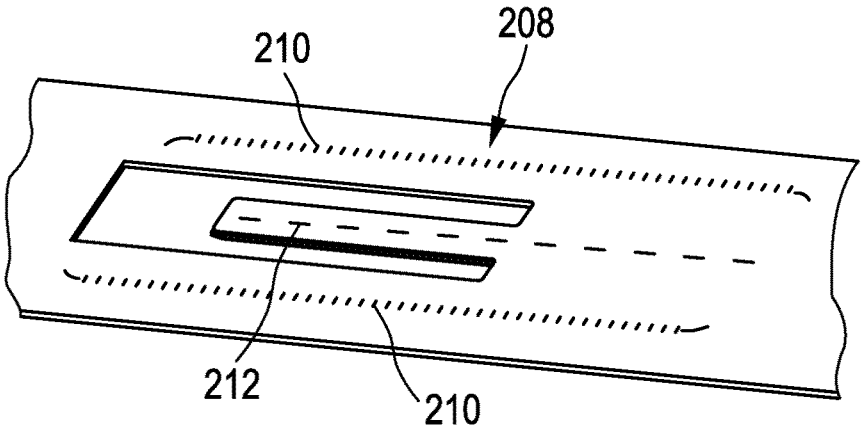
Figure 16C:
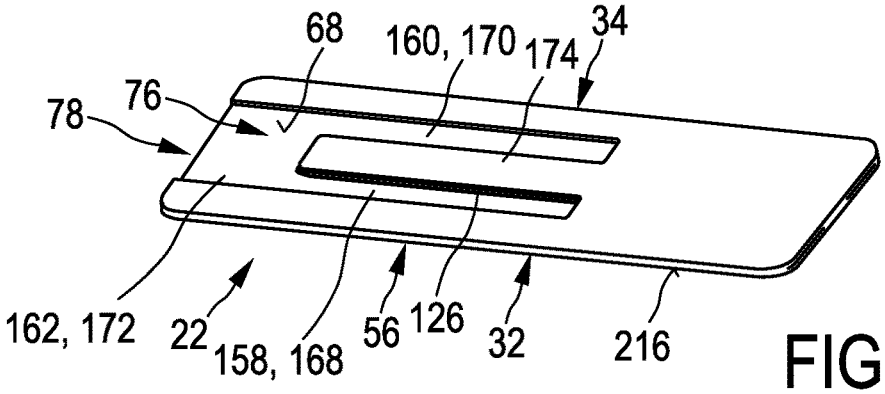
Figure 16D:
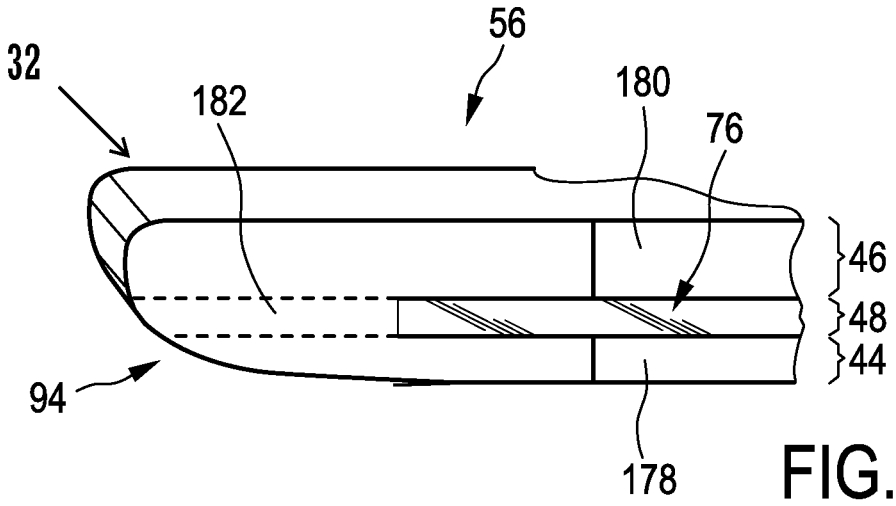
Figure 16E:
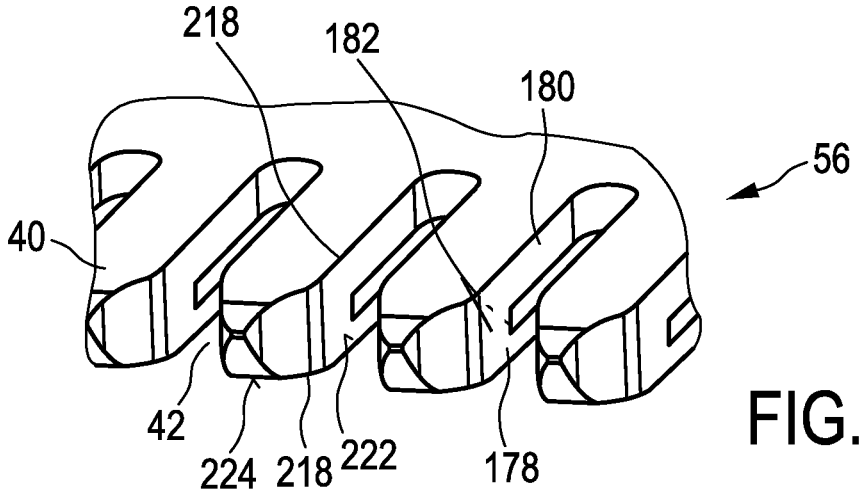
Figure 16F:
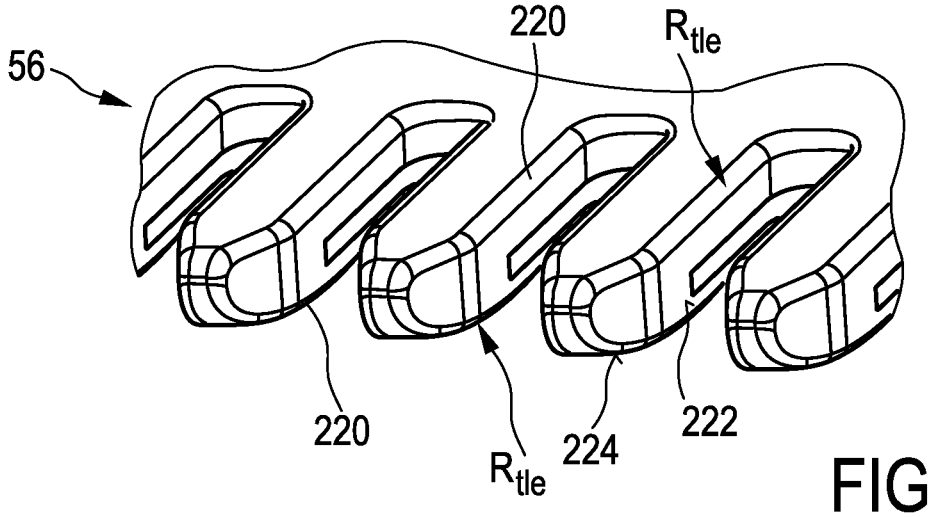
Figure 17:
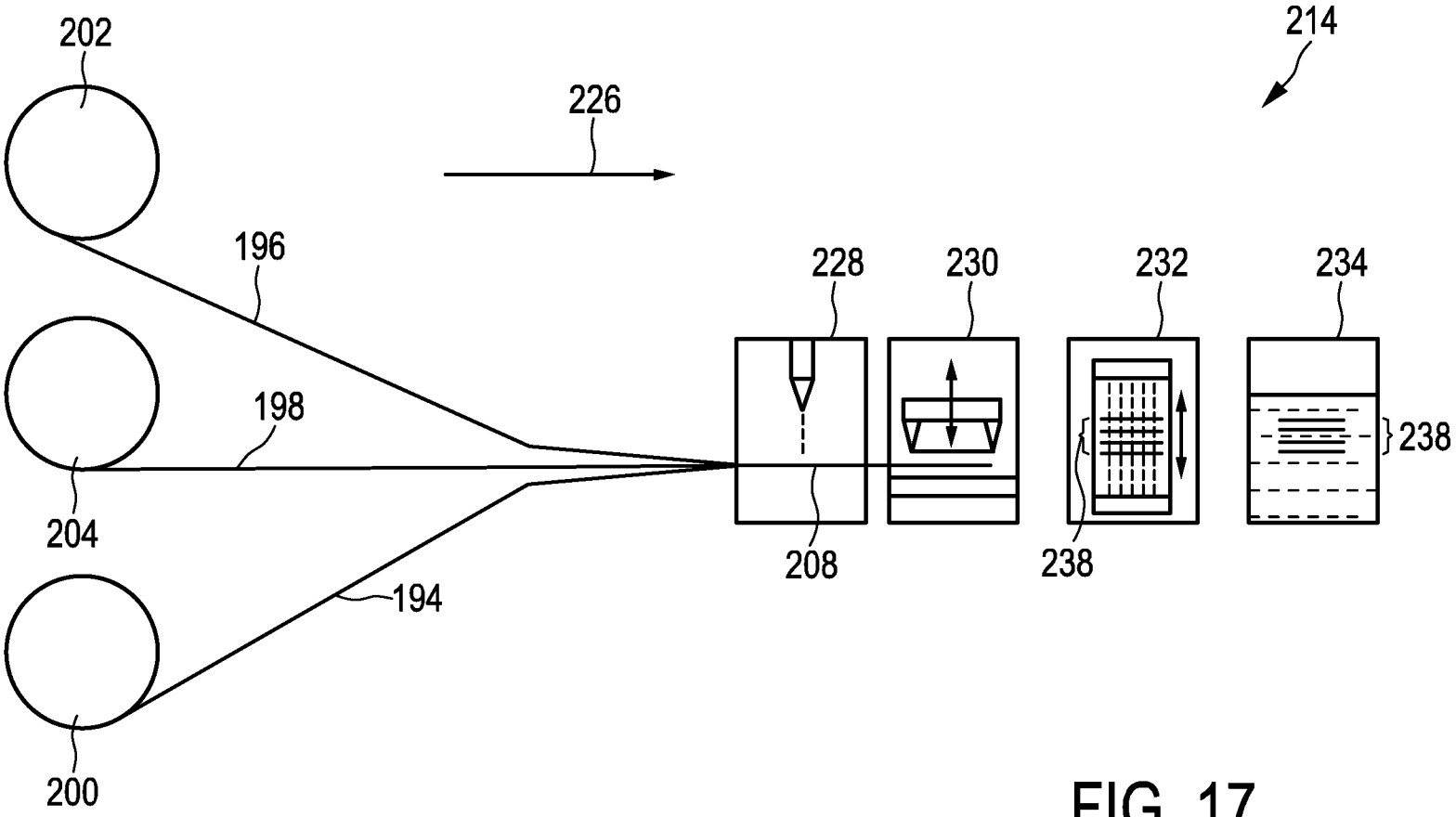
FIG. 17 illustrates a simplified schematic view of an exemplary embodiment of a system for manufacturing a layered or segmented stationary blade for a blade set in accordance with the present disclosure.

With particular reference to FIGS. 16*a*-16*f*, and with further reference to FIG. 17, an exemplary manufacturing method and an exemplary manufacturing system for a stationary blade 22 of a blade set 20 in accordance with several aspects of the present disclosure are illustrated and further detailed. As can be seen in FIG. 16*a*, the first layer 50, the second layer 52 and the intermediate layer 54, at least one of them, may be provided in the form of strip material. The first layer 50 may be obtained from a first strip 194. The second layer 52 may be obtained from a second strip 196. The intermediate layer 54 may be obtained from an intermediate strip 198. Further reference in this connection is made to FIG. 18. As already indicated in FIG. 16*a*, at least some of the strips 194, 196, 198 may be pre-machined or pre-processed. At the preliminary stage illustrated in FIG. 16*a*, a cut-out portion 68 may be processed in the intermediate strip 198 defining the intermediate layer 54. The cut-out portion 68 may comprise a substantially U-shaped form. Different shapes may be likewise envisaged. Particularly, the cut-out portion 68 may comprise a first leg 158, a second leg 160, and a transition portion 162 connecting the first leg 158 and the second leg 160. The first leg 158, the second leg 160 and the transition portion 162 define the inner guide portion 126 in the intermediate layer 54.

Similarly, also the second layer 52 formed by the second strip 196 may be provided with a cut-out portion 166. For instance, the cut-out portion 166 may comprise a substantially U-shaped form. Different shapes may be likewise envisaged. The cut-out portion 166 may comprise a first leg 168, a second leg 170, and a transition portion 172 connecting the first leg 168 and the second leg 170. The first leg 168, the second leg 170 and the transition portion 172 may define therebetween a guide tab 174. Generally, regardless of its actual shape and size, the cut-out portion 166 may be regarded as an opening in the stationary blade 22 through which the drive engagement member 26 (refer to FIG. 3 in this regard) may contact and drive the movable blade 24 for relative cutting motion with respect to the stationary blade 22. Consequently, when fitted to the hair cutting appliance 10, the cut-out portion 166 at the second layer 52 may face the housing 12 and face away from the skin during operation.

As can be further seen in FIG. 16*a*, at least the first layer 50, preferably each layer 50, 52, 54, may comprise a substantially flat or planar shape. Each of the strips 194, 196, 198 may be provided as metal strip, particularly as strip of stainless steel. However, in some embodiments, at least one of the second layer 52 and the intermediate layer 54 may be formed from a different material, e.g., from a non-metal material. Generally, hair cutting functionality as such is performed, at the level of the stationary blade 22, by cutting edges of the first layer 50 (or: the first wall portion 44) that cooperate with respective cutting edges at the level of the movable blade 24. It is therefore often preferred that at least the first layer 50 is formed from metal material, particularly from stainless steel. Each of the layers 50, 52, 54 may be provided as sheet material. The sheet material may be supplied from respective sheet metal reels or, in general, from sheet metal blanks.

As can be seen in FIG. 16*b*, the first layer 50, the second layer 52 and the intermediate layer 54 may be mutually aligned in preparation of being interconnected. Particularly, the respective layers may be fixedly connected by bonding or, more preferably, by welding. A resulting bonded strip is indicated in FIG. 16*b* by reference number 208. Welding the respective layers 50, 52, 54 may particularly involve laser welding. The layers 50, 52 and 54 may be bonded at their leading edges (reference numeral 210 in FIG. 16*b*). Furthermore, in some embodiments, the layers 50, 52, 54 may be bonded at their longitudinal center portion, where the inner guide portion 126 and the guide strip 174 are present (reference number 212). Welding may involve the formation of continuous welds and/or spot welds.

As can be seen in FIG. 16*c*, following the interconnecting or bonding step illustrated in FIG. 16*b*, a separating step may follow in which the layered stack 56 is separated from or cut off the bonded strip 208. When cutting the bonded strip 208 such that at least a small lateral portion of the cut-out portions 68 and/or 166 is cut off from the resulting layered stack 56, the lateral opening 78 may be formed through which the guide slot 76 may be accessible. The cutting or separating operation may further define a basically rectangular outline 216 of the layered stack.

At a further stage, illustrated in FIG. 16*d*, at least one leading edge 94 of the layered stack may be processed, which may particularly involve material-removing processing, so as to define or form the at least one transitional region 94 (refer also to FIGS. 5, 6 and 7*a*). As can further seen in FIG. 16*d*, the leading edge 32 of the layered stack 56 may comprise a substantially U-shaped form that is also present in the teeth after tooth processing. Particularly, the guide slot 76 may longitudinally extend at least partially into the leading edge 32, such that a first tooth leg 178, a second tooth leg 180 and a connector region 182 are defined. The first tooth leg 178 may be primarily defined by the first wall portion 44 (or: the first layer 50). The second tooth leg 180 may be primarily formed from the second wall portion 46 (or: the second layer 52). The connecting region 182 may be primarily formed from the intermediate wall portion 48 (or: the intermediate layer 54). Processing the leading edge 94 may involve material-removing processing, particularly electro-chemical machining.

At a further manufacturing stage, the layered stack 56 may be further provided with teeth 40 and respective tooth spaces 42 at the at least one leading edge (32, 34). Tooth machining may involve material-removing processing to form a plurality of slots that may define the tooth spaces so as to further define therebetween a plurality of teeth 40. Teeth machining may involve cutting operations. Particularly, teeth machining may involve wire eroding. As can be further seen in FIG. 16*e*, at the intermediate manufacturing stage, the teeth 40 may comprise sharp transitioning edges 218, where lateral surfaces 222 and contact surfaces 224 thereof are connected.

At a further manufacturing stage shown in FIG. 16*f* which may succeed the stage illustrated in FIG. 16*e*, the toothed layered stack 56 may be further machined or, more generally, processed. Particularly, the sharp edges 218 that may be present after the formation of the teeth 40 may be rounded. Consequently, rounded edges 220 having a tooth lateral edge radius Rue may be formed. Rounding may involve material-removing processing, particularly electro-chemical machining. Further reference is made to FIG. 8 in this regard. By way of example, the radius Rue of the curved edge transition may be in the range of about 0.05 mm to 0.07 mm, particularly in the range of about 0.053 mm to 0.063 mm.

It is worth to be mentioned in connection with FIGS. 16*a*-16*f* that their order and the order of the respective manufacturing stages do not necessarily involve and prescribe a fixed manufacturing order. For instance, the manufacturing steps illustrated in FIGS. 16*d* and 16*e* may be shifted or, more particularly, interchanged. Furthermore, in some embodiments of the manufacturing method the step of forming the transitional region and the step of forming the toothed shape may be performed even concurrently or, at least, temporally overlapping.

FIG. 17 illustrates a manufacturing system 214 for manufacturing a stationary blade 22 in accordance with several aspects of the present disclosure. Particularly, at least some of the preliminary and intermediate stages illustrated in FIGS. 16*b*-16*f* may be performed or processed using the manufacturing system 214.

The respective strip material 194, 196, 198 for forming the first layer 50, the second layer 52 and the intermediate layer 54 may be supplied from respective reels 200, 202, 204. The first strip 194 may be supplied from the first reel 200. The second strip 196 may be supplied from the second reel 202. The intermediate strip 198 may be provided from the intermediate reel 204. A feed direction is indicated in FIG. 17 by reference number 226. In some embodiments, the reels 202 and 204 may already comprise the respective cut-out portions 166 and 68 for the second layer 52 and the intermediate layer 54. It may be further envisaged to provide reel material also for the second strip 196 and the intermediate strip 198 that comprises a filled surface, i.e., a surface without respective cut outs. In this case the manufacturing system 214 may further comprise at least one cutting or stamping unit for forming the respective cut outs 166, 68 in the strips 196, 198.

According to the embodiment illustrated in FIG. 17, the reels 202, 204 may comprise pre-manufactured or pre-processed strips 196, 198. The strip material 194, 196, 198 forming the respective first, second and intermediate layer 50, 52, 54 may be supplied or forwarded to a bonding device 228. In general, the bonding device 228 may also be referred to as interconnecting or fixing device. At the bonding device 228, respective portions of the strips 194, 196, 198 may be received, supported and put into alignment. In this respect, further reference is made to FIG. 18 showing a top view representation of pre-processed or pre-machined strips 194, 196, 198. It is noted in this connection that the strips 194, 196, 198 do not necessarily have to be provided from reels 200, 202, 204. Rather, also flat pre-products, e.g. sheets or blanks, may be used. Some or each of the strips 194, 196, 198 may be provided with respective corresponding alignment elements 242, 244. The alignment elements 242, 244 may provide for mutual positional alignment between respective portions of the strips 194, 196, 198 in the longitudinal direction X and the lateral or transverse direction Y. By way of example, the first alignment elements 242 in the strips 194, 196, 198 may provide for alignment in both the longitudinal direction and the transverse (or: lateral) direction. Furthermore, the alignment elements 244 in the strips 194, 196, 198 may generally provide for alignment in the transverse (or: lateral) direction. In this way, a positional over-determination of the strips 194, 196, 198 can be prevented. In some embodiments, the alignment elements 242 can be shaped as cylindrical holes. By contrast, the alignment elements 244 may be shaped as elongated holes. Being sufficiently aligned and stacked in the bonding or interconnecting device 228, the respective strips 194, 196, 198 may be fixedly interconnected, preferably bonded, more preferably welded, thereby forming a bonded strip 208, refer also to FIG. 16*b* in this connection.

The manufacturing system 214 may further comprise a separating device 230, particularly a cutting or stamping device 230. By means of the separating device 230, respective portions of the bonded strip 208 provided by the bonding device 228 and fed to the separating device 230 may be cut off (or: cut out). Again referring to FIG. 18 in this connection, a to-be-separated portion of the bonded strip 208 may have an overall transverse length dimension $l_{tro}$. Each of the alignment elements 242, 244 that are interposed between respective to-be-separated portions of the bonded strip 208 may be arranged at a portion comprising a length waste dimension $l_{wa1}$ and a length waste dimension $l_{wa2}$, respectively. In other words, when cutting respective portions of the bonded strip 208 so as to obtain a plurality of layered stacks 56 having a transversal overall length dimension $l_{tro}$, also clippings or waste portions indicated in FIG. 18 by the respective length waste dimensions $l_{wa1}$ and $l_{wa2}$ can be cut off (or: cut out) the bonded strip 208. It should be mentioned that, merely for illustrative purposes, the bonded layer 208 and the layered stack 56 are shown in FIG. 18 in a spaced-apart exploded view. It is further worth noting that the strips 194, 196, 198 may preferably have the same longitudinal extension $l_{lo}$.

With further reference to FIG. 17, the manufacturing system 214 may further comprise a tooth shape forming device 232, particularly a wire eroding device 232. It is particularly preferred that the device 232 is adapted to process a stack 238 comprising a plurality of layered stacks 56 at the same time. In the tooth shape forming device 232, basically longitudinally extending slots may be generated at respective leading edges 32, 34 of the layered stacks 56, refer also to FIG. 16*e*.

The manufacturing system 214 may further comprise a processing or machining device 234, particularly a device that is capable of electro-chemical processing or machining the layered stacks 56 provided and supplied thereto. In doing so, chamfering and/or rounding processes may be applied to sharp edges at the layered stacks 56, refer also to FIG. 16*f* It should be further noted that, in some embodiments, the processing device 234 may be further capable of forming or machining the at least one transitional region 94 at the layered stacks 56, refer also to FIG. 16*d*. Alternatively, the manufacturing system 214 may comprise a further, distinct processing or machining device, particularly a device that is capable of electro-chemical machining. Such a device may be interposed, for instance, between the separating device 230 and the tooth form shaping device 232, and be capable of forming the at least one transitional region 94 prior to the formation or generation of the teeth 40 of the layered stack. It may be also envisaged to utilize basically the same processing or machining device 234 for processing the at least one transitional region 94 and for rounding or chamfering the teeth 40 at different manufacturing stages.

Figure 19:
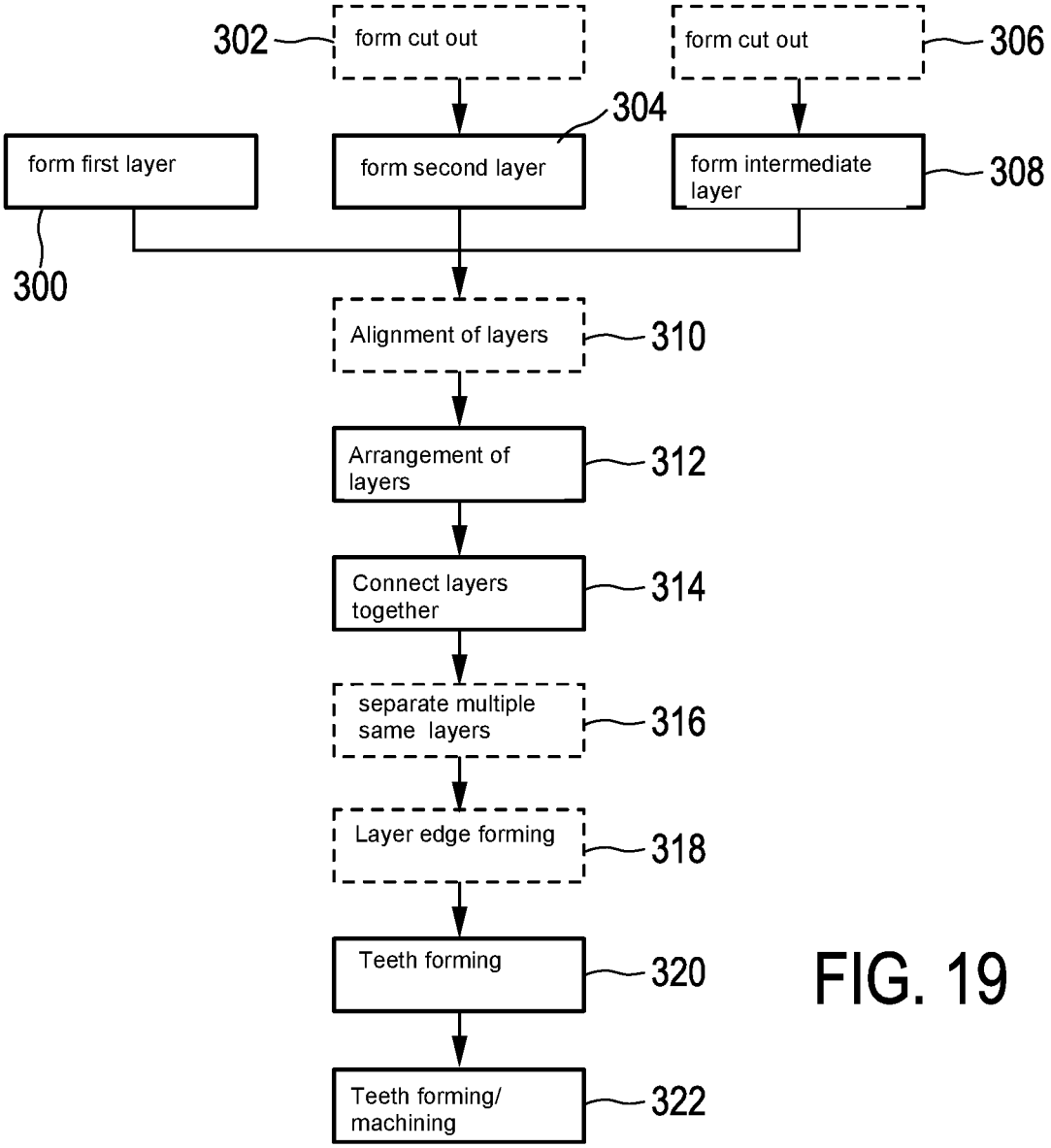
FIG. 19 shows an illustrative block diagram representing several steps of an embodiment of an exemplary manufacturing method in accordance with several aspects of the present disclosure.
Figure 20:
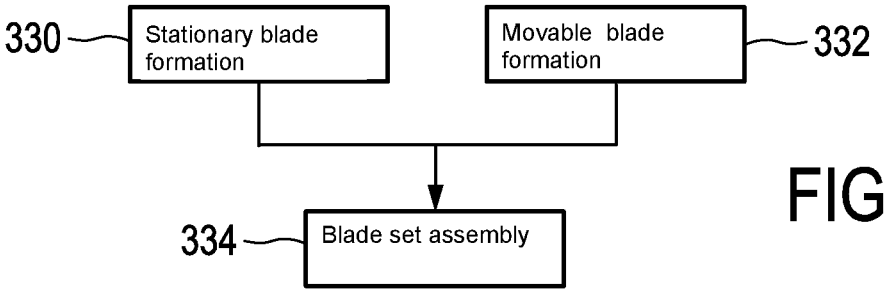
FIG. 20 shows a further illustrative block diagram representing further steps of an embodiment of an exemplary method for manufacturing a blade set in accordance with several aspects of the present disclosure.

With further reference to FIG. 19 and FIG. 20, several steps of an exemplary embodiment of a method for manufacturing a stationary blade and a method for manufacturing a blade set in accordance with several aspects of the present disclosure will be illustrated and further described. FIG. 19 schematically illustrates a method of manufacturing a stationary blade of a blade set. In general, optional steps are indicated in FIG. 19 by dashed blocks. Initially, at steps 300, 304, 308 respective strips for forming a first layer, a second layer and an intermediate layer may be provided or supplied. Preceding the steps 304, 308, further optional steps may take place. The steps 302, 306 may include forming respective cut-out portions in the respective second strip, from which the second layer may be formed, and the intermediate strip, from which the intermediate layer may be formed. However, in the alternative, the steps 302, 306 may be omitted in case pre-processed cut strips may be supplied. An optional alignment step 310 may follow the steps 300, 304, 308. The alignment step may be regarded as a separate step 310, but may, in the alternative, also be included in a subsequent step 312 relating to an arrangement of the respective strips on top of each other in a tight manner. The step 312 may further involve an arrangement of the intermediate strip between the first strip and the second strip. The alignment step 310 may involve a longitudinal and/or lateral (or: transverse) alignment of respective strip portions. Downstream of the step 312, a connecting step 314 may follow, wherein the respective strips may be fixedly interconnected. Particularly, the step 314 may involve a bonding, preferably a welding step. In this way, a bonded strip, particularly a bonded layered strip, may be formed.

In a further, subsequent optional step 316, a respective stack portion may be separated from the bonded strip. This may apply particularly in cases where the bonded strip, or more precisely, the original strips forming the respective layers, is shaped and dimensioned such that a plurality of layered stack segments may be formed therefrom. For instance, each of the first strip, the second strip and the intermediate strip may be provided as elongated sheet metal material, particularly as reel material. In this way, a high number of layered stack segments may be formed on the basis of a single strip. However, in some embodiments, strip portions that are already adapted to a resulting overall shape of the to-be-formed layered stack may be provided at the steps 300, 304, 308. In this case, the separating step 316 may be omitted. In case the alignment of the strips at step 310 is performed under consideration of distinct alignment elements provided in the strips, also the respective alignment portions may be clipped or cut off at the separating step 316.

In some embodiments, an overall tip machining and/or tip smoothening process 318 may follow. At the step 318, at least one transition region may be formed or processed at at least one leading edge of the layered stacks. The step 318 may particularly comprise chamfering and/or rounding processes. At this end, the step 318 may be configured as an electro-chemical machining process. A further step 320 may be provided which may take place downstream (or, in the alternative, upstream) of the optional step 318. The step 320 may be regarded as teeth forming or, more explicitly, teeth cutting step. For instance, the step 320 may involve a cutting operation at the at least one leading edge of the layered stack so as to create a plurality of slots or tooth spaces therein. The step 320 can make use, for instance, of wire-eroding cutting operations. When forming the teeth and tooth spaces in the step 320, generally sharp edges at the teeth may be generated. Consequently, a further step 322 may follow which may involve a material-removing teeth machining operation. Particularly, the step 322 may comprise rounding or chamfering operations at sharp teeth edges. Since at least one cut-out portion may be present in the intermediate strip forming the intermediate layer, arranging, connecting and machining the layers may also generate, at the same time, a guide slot in the layered stack that may house a movable blade. At the end of step 322, a stationary blade for a hair cutting appliance involving a layered structure may be provided.

In other words, more generally, another aspect of the present disclosure may be directed to a method of manufacturing a stationary blade 22 of a blade set 20 for a hair cutting appliance 10, comprising the following steps: providing a first wall segment 50, a second wall segment 52, and an intermediate wall segment 54, at least the first wall segment 50 comprising a substantially flat overall shaping, forming at least one cutout portion 68 in the intermediate wall segment 54; disposing the intermediate wall segment 54 between the first wall segment 50 and the second wall segment 52; fixedly interconnecting, particularly bonding, the first wall segment 50, the second wall segment 52, and the intermediate wall segment 54, thereby forming a segmented stack 56, such that the first wall segment 50 and the second wall segment 52 at least partially cover the at least one cutout in the intermediate wall segment 54 arranged therebetween, wherein the first wall segment 50, the second wall segment 52, and the intermediate wall segment 54 comprise a substantially equivalent overall dimension, wherein the step of interconnecting the first wall segment 50, the second wall segment 52, and the intermediate wall segment 54 further comprises: forming, at a longitudinal end of the segmented stack 56, at least one leading edge 32, 34, where the first wall segment 50, the second wall segment 52, and the intermediate wall segment 54 are jointly connected; forming a guide slot 76 for a movable blade 24, the guide slot 76 defined by the at least one cutout portion 68 in the intermediate wall segment 54, the first wall segment 50 and the second wall segment 52; and forming, at the at least one leading edge 32, 34 of the segmented stack 56, a plurality of mutually spaced apart projections 36 alternating with respective slots, thereby defining a plurality of teeth 40 and respective tooth spaces 42. The wall segments 50, 52,54 may be formed by respective layers.

Now referring to FIG. 20, an exemplary embodiment of a method of manufacturing a blade set for a haircutting appliance is presented. The method may comprise a step 330, wherein a stationary blade that has been manufactured in accordance with several aspects of the manufacturing method described herein before may be supplied. It is preferred that the stationary blade comprises an opening, particularly a lateral opening, through which a guide slot in the stationary blade is accessible. At a further step 332, a respective movable blade 24 comprising at least one toothed leading edge may be supplied. An assembling step 334 may follow, in which the movable blade is inserted into the guide slot of the stationary blade. Particularly, it is preferred that the movable blade is passed through the lateral opening at a transverse (or: lateral) end of the stationary blade.

It is emphasized that the manufacturing method introduced and explained above shall not be construed as the only conceivable approach for manufacturing a blade set embodiment that is shaped in accordance with several beneficial aspects of the present disclosure. Particularly, where structural features of the blade set are elucidated and explained in this disclosure, these features do not necessarily relate to a particular manufacturing method. Several manufacturing methods for producing stationary blades may be envisaged. Whenever the description of the structural features refers to the manufacturing method mentioned above, this shall be construed as illustrative additional information for the sake of understanding, and shall not be construed as limiting the disclosure to the disclosed manufacturing steps.

It is further emphasized that, wherever terms like "first layer", "second layer" and "intermediate layer" are used herein in connection with the structure of the stationary blade, these may be readily replaced by "first wall portion", "second wall portion" and "intermediate wall portion", respectively, without departing from the scope of the present disclosure. The terms "first layer", "second layer" and "intermediate layer" and "layered stack" shall not be construed as to restrict the disclosure only to embodiments of stationary blades that are actually composed of sliced (e.g., sheet metal-) sub-components that are actually (physically) distinct from one another before being interconnected during the manufacturing process.

Needless to say, in an embodiment of a blade set manufacturing method in accordance with the disclosure, several of the steps described herein can be carried out in changed order, or even concurrently. Further, some of the steps could be skipped as well without departing from the scope of the invention.

Although illustrative embodiments of the present invention have been described above, in part with reference to the accompanying drawings, it is to be understood that the invention is not limited to these embodiments. Variations to the disclosed embodiments can be understood and effected by those skilled in the art in practicing the claimed invention, from a study of the drawings, the disclosure, and the appended claims.

Reference throughout this specification to "one embodiment" or "an embodiment" means that a particular feature, structure or characteristic described in connection with the embodiment is included in at least one embodiment of the stationary blade, the blade set, etc. according to the present disclosure. Thus, the appearances of the phrases "in one embodiment" or "in an embodiment" in various places throughout this specification are not necessarily all referring to the same embodiment. Furthermore, it is noted that particular features, structures, or characteristics of one or more embodiments may be combined in any suitable manner to form new, not explicitly described embodiments.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A segmented stationary blade for a blade set for a hair cutting appliance, said blade set being arranged to be moved through hair in a moving direction during operation to cut said hair, said stationary blade comprising:

a first wall portion arranged to serve as a skin facing wall portion during operation, said first wall portion comprising a first planar layer;

an intermediate wall portion comprising an intermediate planar layer, said intermediate planar layer including a cutout portion comprising:

a first leg a second leg, a transition portion connecting a first section of the first leg and a first section of the second leg, wherein the first leg and the second leg define, therebetween, an inner guide portion extending entirely across the intermediate wall portion; and a second wall portion positioned on the intermediate wall portion, said second wall portion comprising a second planar layer, wherein the first wall portion, the intermediate wall portion and the second wall portion form a segmented stack and jointly form, at an end of the segmented stack, a first toothed leading edge, at least partially extending in a direction (Y, t) transverse to the moving direction, wherein the intermediate wall portion forms a filled portion that connects the first wall portion and the second wall portion at the first toothed leading edge and said cutout portion extends to an edge of the segmented stack transverse to the first toothed leading edge to define an opening in the segmented stack, wherein the first toothed leading edge comprises:

a plurality of mutually spaced apart projections, defining a plurality of teeth, wherein the plurality of mutually spaced apart projections at least partially extend forwardly in a longitudinal direction (X, r) approximately perpendicular to the direction (Y, t) transverse to the moving direction.

2. The stationary blade as claimed in claim 1, further comprising:

a second toothed leading edge formed at a second end of the segmented stack, wherein the second toothed leading edge faces away from the first toothed leading edge, wherein the second toothed leading edge comprises:

a plurality of second mutually spaced apart projections, defining a second plurality of teeth, wherein the plurality of second mutually spaced apart projections at least partially extend in the longitudinal direction (X, r) approximately perpendicular to the transverse direction (Y, t).

3. A hair cutting appliance comprising:

a blade set, said blade set being arranged to be moved through hair in a moving direction to cut said hair, said blade set comprising:

a stationary blade comprising:

a first wall portion arranged to serve as a skin facing wall portion during operation;

a second wall portion, and an intermediate wall portion, the intermediate wall portion comprising:

a centrally located cutout portion extending toward an edge of the intermediate wall portion, said cutout portion comprising:

a first leg, a second leg, and a transition portion connecting the first leg and the second leg, wherein the first leg and the second leg defining, therebetween, an inner guide portion extending entirely across the intermediate wall portion, said inner guide portion comprising:

at least one outwardly facing guide surface, wherein the first wall portion, the intermediate wall portion, and the second wall portion form a segmented stack, wherein said cutout portion forms a guide slot within said segmented stack and wherein a stationary blade first toothed leading edge is formed at an end of the segmented stack, said stationary blade first toothed leading edge extending in a direction (Y, t) transverse to the moving direction;

wherein the stationary blade first toothed leading edge comprises:

a plurality of mutually spaced apart projections, defining a plurality of teeth, extending in a longitudinal direction (X, r) approximately perpendicular to the direction (Y, t) transverse to the moving direction; and a movable blade, movably arranged within the guide slot, said movable blade comprising:

a movable blade first toothed leading edge, and at least one contact portion, extending into the cutout portion, said at least one contact portion configured to contact a corresponding one of the at least one outwardly facing guide surface of said inner guide portion, wherein the movable blade first toothed leading edge cooperates with the stationary blade first toothed leading edge to enable cutting of hair caught therebetween as a position of the movable blade varies.

4. The hair cutting appliance as claimed in claim 3, wherein the movable blade is unbiasedly mounted in the guide slot, in at least in one of: a vertical height direction (Z) and the longitudinal direction (X, r).

5. The hair cutting appliance as claimed in claim 3, wherein the movable blade comprises an overall dimension in the longitudinal direction that is smaller than a dimension of the cutout portion in the longitudinal direction at the edge of the the intermediate wall portion.

6. The hair cutting appliance as claimed in claim 3, further comprising:

a motor configured to:

drive the movable blade with respect to the stationary blade.

7. The hair cutting appliance as claimed in claim 3, wherein the at least one contact portion contacts the inner guide portion, such that the movable blade, when housed in the stationary blade, is guided for movement in said direction transverse to the moving direction with respect to the stationary blade.

8. The hair cutting appliance as claimed in claim 3, wherein the movable blade comprises a first arm, a second arm, and a connector portion configured to connect the first arm and the second arm, the first arm is configured to be mounted within the first leg of the cutout portion, the second arm is configured to be mounted within the second leg of the cutout portion, wherein the first arm comprises a first inwardly facing contact portion of said at least one contact portion facing a first outwardly facing guide surface of at least one outwardly facing guide surface, and the second arm comprises a second inwardly facing contact portion of said at least one contact portion facing a second outwardly facing guide surface of the at least one outwardly facing guide surface.

9. The hair cutting appliance as claimed in claim 8, wherein the first inwardly facing contact portion comprises at least one respective contact element formed as at least one inwardly extending guiding tab, wherein the second inwardly facing contact portion comprises at least one respective contact element formed as at least one inwardly extending guiding tab, and wherein the at least one inwardly extending guiding tab of the first inwardly facing contact portion and the at least one inwardly extending guiding tab of the second inwardly facing contact portion are spaced apart by a clearance dimension ($l_{gt}$) that is adapted to an extension ($l_{gp}$) of the inner guide portion for providing clearance fit mating, in the longitudinal direction (X, r), of the movable blade in the guide slot.

10. The hair cutting appliance as claimed in claim 9, wherein each of said at least one inwardly extending guiding tab of said first inwardly facing contact portion and each of said at least one inwardly extending guiding tab of said second inwardly facing contact portion comprises:

a convexly curved contact surface.

11. A hair cutting appliance, comprising:

a housing accommodating a motor; and a blade set comprising a stationary blade and a movable blade, wherein the stationary blade is connectable to the housing, and wherein the movable blade is operably connectable to the motor, said stationary blade comprising:

a first wall portion arranged to serve as a skin facing wall portion during operation;

a second wall portion, and an intermediate wall portion, disposed between the first wall portion and the second wall portion, wherein the first wall portion, the intermediate wall portion and the second wall portion being placed one on another to forma segmented stack and jointly form a toothed leading edge at an end of the segmented stack, said toothed leading edge at least partially extending in a direction (Y, t) transverse to a moving direction, said intermediate wall portion comprising:

a centrally located cutout portion, extending toward an edge of the segmented stack transverse to the toothed edge, said cutout portion forming a guiding slot in the segmented stack, said cutout portion comprising:

a first leg;

a second leg; and a transition portion connecting the first leg and the second leg, said first leg and second leg forming an inner guide portion, therebetween, said inner guide portion extending entirely across the intermediate wall portion, said inner guide portion comprising:

at least one outwardly facing guide surface facing the toothed edge of the stationary blade, wherein the toothed edge of the stationary blade comprises:

a plurality of mutually spaced apart projections, defining a plurality of teeth, wherein the plurality of mutually spaced apart projections extend in a longitudinal direction (X, r) approximately perpendicular to the direction (Y, t) transverse to the moving direction; and within the cutout portion, said movable blade comprising:

a toothed leading edge, wherein the toothed leading edge of the movable blade cooperates with the toothed edge of the stationary blade to enable cutting of hair caught therebetween; and a first arm configured to be mounted within the first leg of the cutout portion, said first arm comprising:

a first inwardly facing contact portion, extending into the cutout portion, said first arm configured to contact the inner guide portion, a second arm configured to be mounted within the second leg of the cutout portion, said second arm comprising:

a second inwardly facing contact portion, extending into the cutout portion, configured to contact the inner guide portion, and a connector portion configured to connect the first arm and the second arm, wherein the motor is configured to drive the movable blade within the guide slot in one of: a linear movement and a circular movement.

* * * * *